US010077166B2

(12) United States Patent
Honda et al.

(10) Patent No.: US 10,077,166 B2
(45) Date of Patent: Sep. 18, 2018

(54) ROLL RETAINER, AND IMAGE FORMING APPARATUS

(71) Applicants: Ryo Honda, Kanagawa (JP); Kikuya Nakada, Kanagawa (JP)

(72) Inventors: Ryo Honda, Kanagawa (JP); Kikuya Nakada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 268 days.

(21) Appl. No.: 14/936,776

(22) Filed: Nov. 10, 2015

(65) Prior Publication Data

US 2016/0130110 A1 May 12, 2016

(30) Foreign Application Priority Data

Nov. 12, 2014 (JP) ..... 2014-229856
Mar. 17, 2015 (JP) ..... 2015-053826

(51) Int. Cl.
*B65H 75/24* (2006.01)
*B65H 75/18* (2006.01)

(52) U.S. Cl.
CPC ..... *B65H 75/242* (2013.01); *B65H 75/185* (2013.01)

(58) Field of Classification Search
CPC ... B65H 75/185; B65H 75/242; B65H 75/248
See application file for complete search history.

(56) References Cited

U.S. PATENT DOCUMENTS 5,820,069 A 10/1998 Segura Salvador et al.
7,931,229 B2 4/2011 Genta
8,817,329 B2 8/2014 Satoh et al.
8,926,202 B2 1/2015 Nakada
9,004,390 B2 4/2015 Morinaga et al.
2012/0032021 A1 2/2012 Morinaga et al.
2015/0077457 A1 3/2015 Nakada

FOREIGN PATENT DOCUMENTS

CN 1185405 A 6/1998
CN 2846371 Y 12/2006
CN 101497405 A 8/2009
JP H07-253695 10/1995
JP 2000-109256 4/2000
(Continued)

OTHER PUBLICATIONS

Jan. 26, 2017 Chinese official action (and English translation thereof) in connection with related Chinese patent application No. 201510756932.3.

*Primary Examiner* — William E Dondero
(74) *Attorney, Agent, or Firm* — Cooper & Dunham LLP

(57) ABSTRACT

Disclosed is a roll retainer fitting into ends of a roll to retain the roll. The roll retainer includes a retaining member having a flange facing one end of the roll; two or more supporting members pivotally retained by the retaining member, each of the supporting members being movable along an axial direction within a plane between a supporting position at which the supporting member is inserted in a hollow shaft of the roll and a retracted position at which the supporting member is retracted from the supporting position; and a linking device configured to couple the supporting members, the supporting members being linked with one another to be moved between the supporting positions and the retracted positions.

8 Claims, 28 Drawing Sheets

(56) References Cited

FOREIGN PATENT DOCUMENTS

| | | |
|---|---|---|
| JP | 2007-290865 | 11/2007 |
| JP | 4816192 | 11/2011 |
| JP | 2012-066932 | 4/2012 |
| JP | 2013-100154 | 5/2013 |
| JP | 2013-121872 | 6/2013 |
| JP | 2015-129028 | 7/2015 |

ROLL RETAINER, AND IMAGE FORMING APPARATUS

BACKGROUND OF THE INVENTION

1. Field of the Invention

The disclosures herein generally relate to a roll retainer and an image forming apparatus.

2. Description of the Related Art

Image forming apparatuses having rolls of printing media (roll-type printing medium) generally have a roll retainer (a retaining mechanism) to accommodate different cardboard tubes (difference in inner diameters of the hollow shafts of the rolls).

An example of a related art retainer includes an abutment member configured to be in contact with an inner peripheral surface of the hollow shaft rolls in an axial direction of the roll-type medium as a fulcrum to be expanded in a roll diameter direction, thereby adapting to the differences in the inner diameters of the cardboard tube (e.g., Japanese Laid-open Patent Publication No. 2007-290865, hereinafter referred to as "Patent Document 1").

Further, another example related art retainer is configured to regulate a retractable position of a supporting member (e.g., Japanese Laid-open Patent Publication No. 2013-100154, hereinafter referred to as "Patent Document 2"). In this example, the retractable position of the supporting member is regulated by allowing the supporting member to be in contact with an inner peripheral surface of the core tube and an outer peripheral surface of a shaft center of the retaining member when a diameter of the roll-type medium is large, and moving the supporting member to be in contact with an end part of the core tube when the diameter of the roll-type medium is small.

However, in the configuration of Patent Document 1, since the abutment member expands in the axial direction of the roll-type medium as a fulcrum, the expanded abutment member is susceptible to breakage by rotation in circumferential direction.

Further, in the configuration of Patent Document 2, it is not possible to simultaneously move two or more abutment members, and the roll-type medium may be attached to the retaining mechanism without moving some of the abutment members. As a result, the roll-type medium may be attached to the retaining mechanism unsteadily.

RELATED ART DOCUMENTS

Patent Documents

Patent Document 1: Japanese Laid-open Patent Publication No. 2007-290865

Patent Document 2: Japanese Laid-open Patent Publication No. 2013-100154

SUMMARY OF THE INVENTION

Accordingly, it is a general object in one embodiment of the present invention to provide a technology capable of retaining the rolls having different inner diameters by easily adjusting the different inner diameters that substantially obviates one or more problems caused by the limitations and disadvantages of the related art.

According to an aspect of embodiments, there is provided a roll retainer fitting into ends of a roll to retain the roll. The roll retainer includes a retaining member having a flange facing one end of the roll; two or more supporting members pivotally retained by the retaining member, each of the supporting members being movable along an axial direction within a plane between a supporting position at which the supporting member is inserted in a hollow shaft of the roll and a retracted position at which the supporting member is retracted from the supporting position; and a linking device configured to couple the supporting members, the supporting members being linked with one another to be moved between the supporting positions and the retracted positions.

Other objects, features and advantages of the present invention will become more apparent from the following detailed description when read in conjunction with the accompanying drawings.

DETAILED DESCRIPTION OF THE PREFERRED EMBODIMENTS

Figure 1:
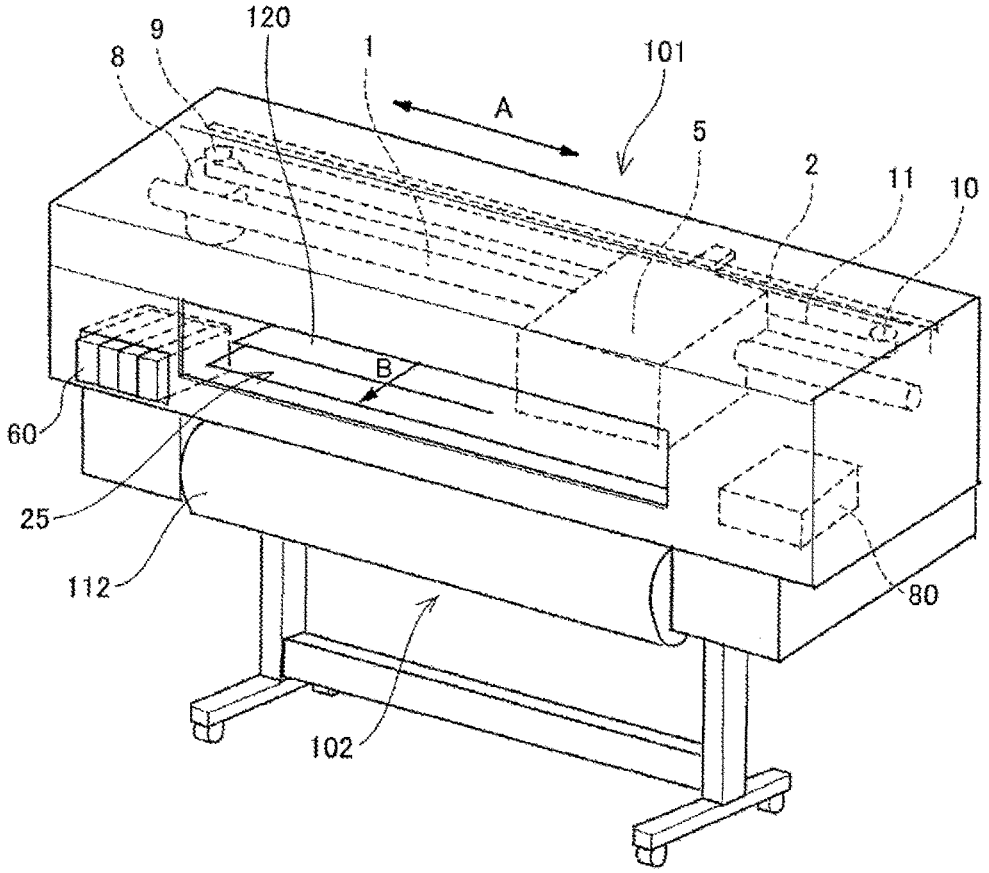
FIG. 1 is an external perspective diagram illustrating an example of an image forming apparatus having a roll retainer according to an embodiment.
Figure 2:
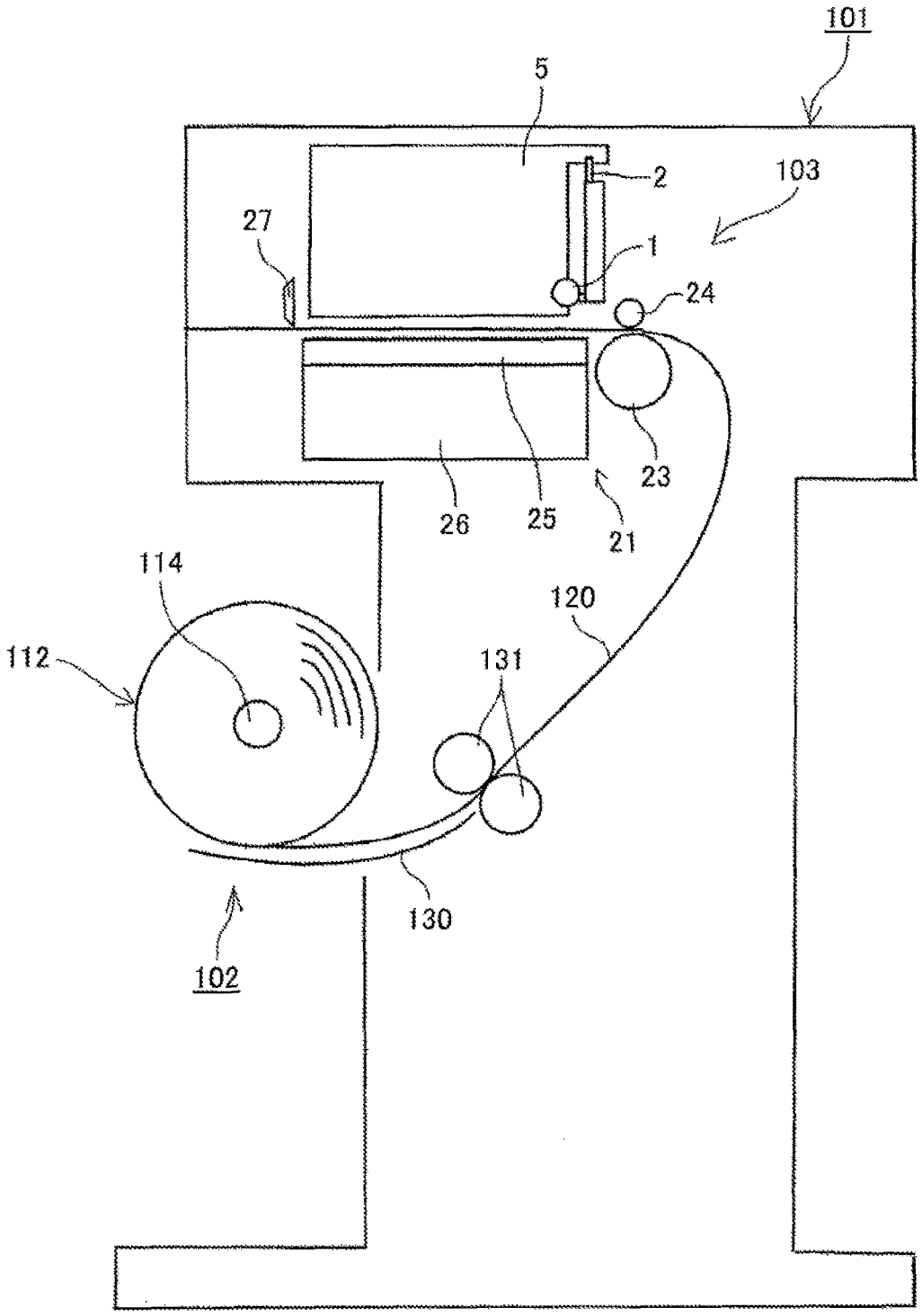
FIG. 2 is a schematic side diagram illustrating the image forming apparatus illustrated in FIG. 1.
Figure 3:
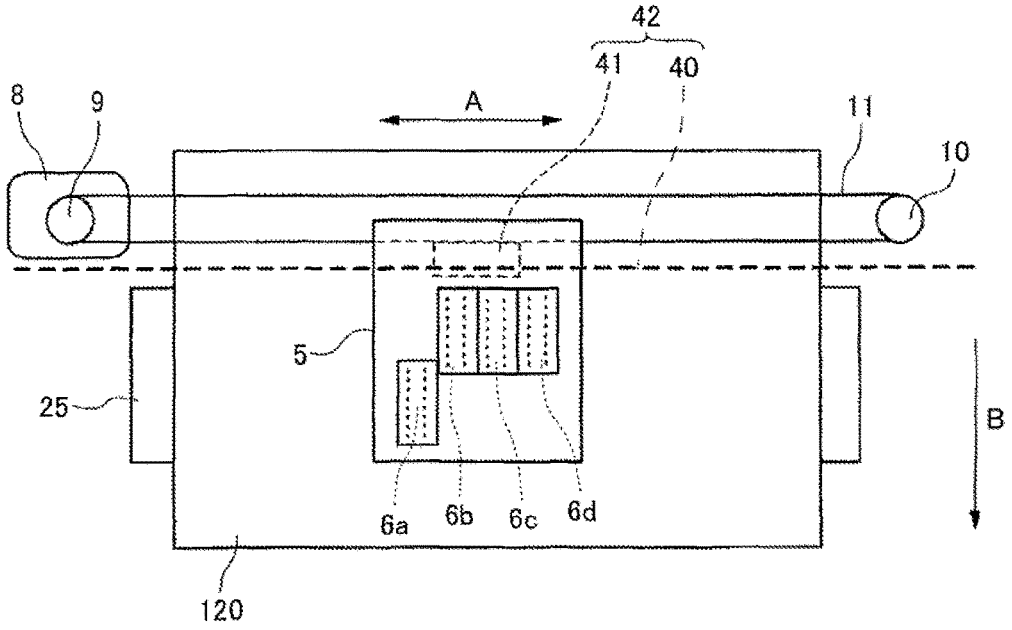
FIG. 3 is a plan diagram illustrating a main part of the image forming apparatus illustrated in FIG. 1.

In the following, a description is given of embodiments of the present invention with reference to the accompanying drawings. First, an illustration is given, with reference to FIGS. 1 to 3, of an example of an image forming apparatus having a roll retainer according to an embodiment. FIG. 1 is an external perspective diagram illustrating an image forming apparatus, FIG. 2 is a schematic side diagram illustrating the image forming apparatus, and FIG. 3 is a plan diagram illustrating a main part of an image forming part of the image forming apparatus.

This image forming apparatus is a serial-type image forming apparatus that includes an apparatus main body 101 and a sheet feeder 102 disposed beneath the apparatus main body 101. Note that the sheet feeder 102 may be disposed beneath the apparatus main body 101 as a separate apparatus, and may be integrally formed with the apparatus main body 101 as illustrated in FIG. 2.

The apparatus main body includes an image forming part 103 configured to form an image on a roll sheet 120 serving as a roll-type medium fed from the sheet feeder 102.

The image forming part 103 includes a guide rod 1 and a guide stay 2 serving as guide members bridging between opposite side plates, and a carriage 5 being movably held by the guide rod 1 and guide stay 2 in an arrow A direction (a main-scanning direction, or a carriage moving direction).

The image forming part 103 further includes a main scanning motor 8 serving as a drive source to reciprocate the carriages, which is disposed on one end in the main scanning direction. A timing belt 11 is looped over a driving pulley 9 and a driven pulley 10. The driving pulley 9 is rotationally driven by the main scanning motor 8, and the driven pulley 10 is disposed on the other side in the main scanning direction. A not-illustrated belt holder of the carriage 5 is fixed to the timing belt 11, and the carriage 5 is reciprocated in the main scanning direction by driving the main scanning motor 8.

The carriage 5 holds multiple (four in this case) recording heads 6*a* to 6*d* integrating liquid-jet heads and head tanks supplying liquid to the liquid-jet heads.

Note that the position of the recording head 6*a* is shifted from those of the recording heads 6*b* to 6*d* by a distance of one head (by one nozzle array) in a sub-scanning direction orthogonal to the main scanning direction. Further, the recording heads 6 have nozzle arrays formed of nozzles aligned in the sub-scanning direction orthogonal to the main scanning direction, and liquid ejections of the nozzles are directed downward.

Further, each of the recording heads 6*a* to 6*d* has two nozzle arrays. The nozzle arrays of the recording heads 6*a* and 6*b* eject black (K) liquid droplets. One nozzle array of the recording head 6*c* ejects cyan (C) liquid droplets, and the other nozzle array of the recording head 6*c* is unused. Further, one nozzle array of the recording head 6*d* elects yellow (Y) liquid droplets, and the other nozzle array of the recording head 6*d* ejects magenta (M) liquid droplets.

Hence, a monochrome image is formed by using the recording heads 6*a* and 6*b* with one scan (main scanning) to form an image of a two-heads width, and a color image may be formed by using the recording heads 6*b* to 6*d*. Note that the configurations of the heads are not limited to those described above; all the recording heads may be aligned in the main scanning direction.

Ink of respective colors are supplied to the head tanks of the recording heads 6 from ink cartridges serving as replaceable main tanks attached to the apparatus main body 101.

In addition, an encoder sheet 40 is disposed along a moving direction of the carriage 5, and an encoder sensor 41 is disposed on the carriage 5 to read the encoder sheet 40. The encoder sheet 40 and the encoder sensor 41 form a linear encoder 42, and the position and speed of the carriage 5 are detected based on outputs of the linear encoder 42.

On the other hand, an main scanning area of the carriage 5 includes a recording area of the carriage 5. In the recording area of the carriage 5, the roll sheet 120 is fed from the sheet feeder 102, and the fed roll sheet 120 is then intermittently conveyed in a direction orthogonal to the main scanning direction of the carriage 5 (the sub-scanning direction, sheet conveyance direction: an arrow B direction) by a conveyer drive 21.

The conveyer device 21 includes a conveyer roller 23 configured to convey the roll sheet 120 serving as the roll-type medium fed from the sheet feeder 102, and a pressure roller 24 disposed to face the conveyer roller 23. A conveyer guide member 25 and a suction fan 26 are disposed downstream of the conveyer roller 23. The conveyer guide member 25 includes suction holes, and the suction fan 26 is configured to suction liquid from the holes of the conveyer guide member 25.

As illustrated in FIG. 2, a cutter 27 is disposed downstream of the conveyer guide member 25 and the conveyer device 21. The cutter 27 serves as a cutting device configured to cut the roll sheet 120 on which the image is formed by the recording heads 6.

Further, a maintenance-restoration mechanism 80 configured to maintain and restore the recording heads 6 is disposed adjacent to the conveyer guide member 25 on one side of the main scanning direction of the carriage 5.

The sheet feeder 102 includes a roll 112. The roll 112 is a roll-type medium (called "roll sheet" as described above) formed by winding the roll sheet 120 (i.e., rolling a long sheet) around a hollow shaft 114 such as a cardboard tube serving as a core tube in a roll-form.

Note that in this embodiment, the roll 112 having an end part of the roll sheet 120 fixed to the hollow shaft 114 with glue, or the roll 112 having an end part of the roll sheet 120 unfixed to the hollow shaft 114 may be used.

The end part of the roll 112 is retained by a later-described roll retainer according to an embodiment, and is supported by a not-illustrated spool shaft (later-described spool 200).

The apparatus main body 101 includes a guide member 130 configured to guide the roll sheet 120 drawing from the roll 112 disposed in the sheet feeder 102, and a conveyer roller pair 131 configured to feed the roll sheet 120 upward while curving the roll sheet 120.

The roll sheet 120 fed from the roll 112 by rotationally driving the conveyer roller pair 131 is conveyed while being stretched between the conveyer roller pair 131 and the roll 112. The roll sheet 120 passes through the conveyer roller pair 131 and is transferred between the conveyer roller 23 and the pressure roller 24 of the conveyer device 21.

In the image forming apparatus having such a configuration, the carriage 5 moves in the main scanning direction while the conveyer device 21 intermittently transfers the roll sheet 120 from the sheet feeder 102. Then, the recording heads 6 are driven according to image information (printing information) to eject liquid droplets to form a desired image on the roll sheet 120. The roll sheet 120 on which the image is formed is cut by the cutter 27 at a predetermined length, and then ejected in a basket by being guided by a not-illustrated paper ejection guide disposed on the front side of the apparatus main body 101.

Figure 4:
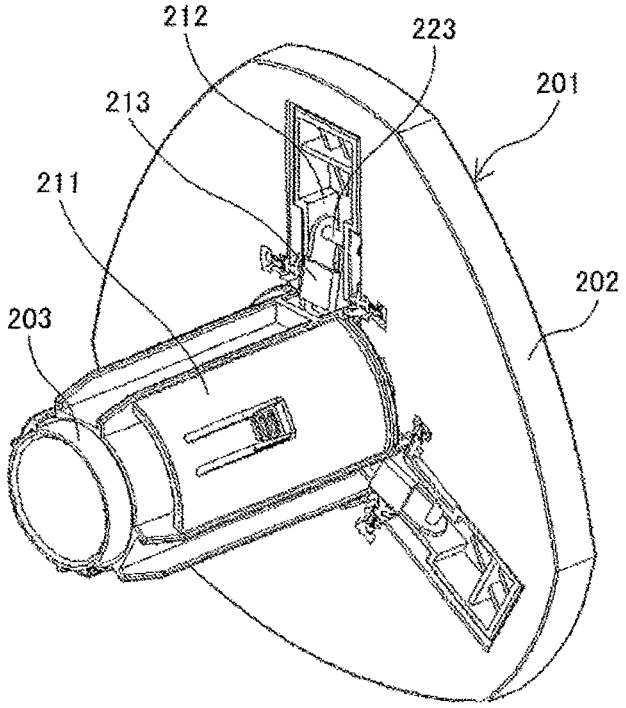
FIG. 4 is a perspective diagram illustrating a roll retainer according to a first embodiment when the roll retainer retains a roll having a first inner diameter.
Figure 5:
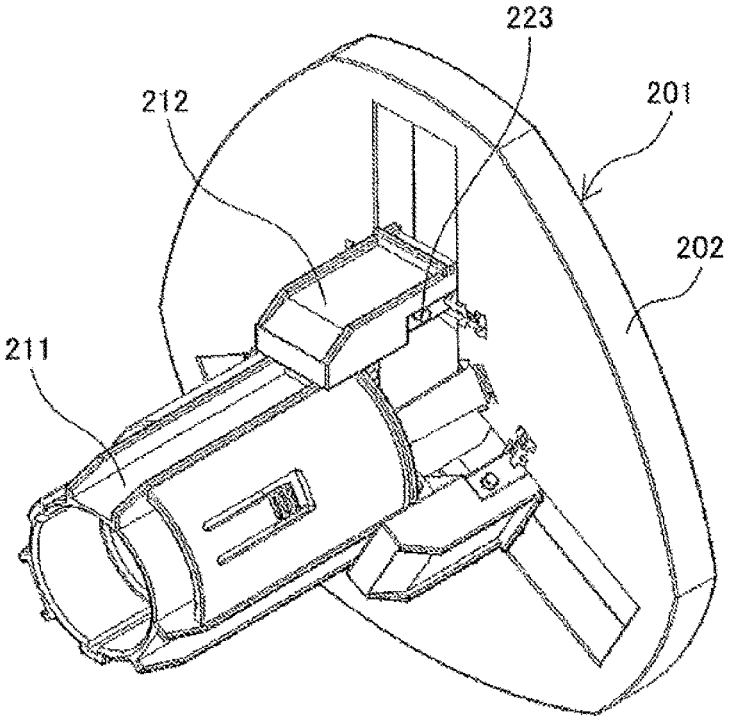
FIG. 5 is a perspective diagram illustrating the roll retainer according to the first embodiment that retains a roll having a second inner diameter.
Figure 6:
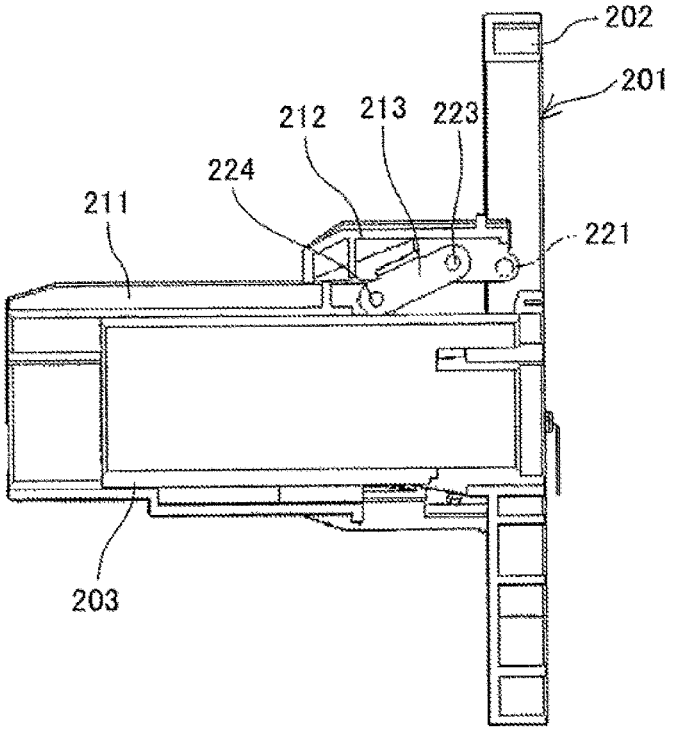
FIG. 6 is a cross-sectional diagram illustrating the roll retainer according to the first embodiment retaining the roll having the second inner diameter.
Figure 7:
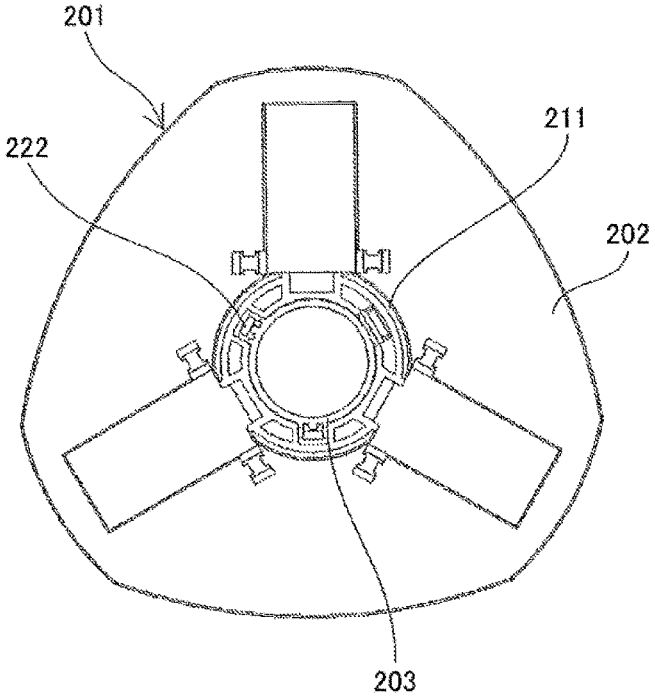
FIG. 7 is a front diagram illustrating a first supporting member of the roll retainer according to the first embodiment.
Figure 8:
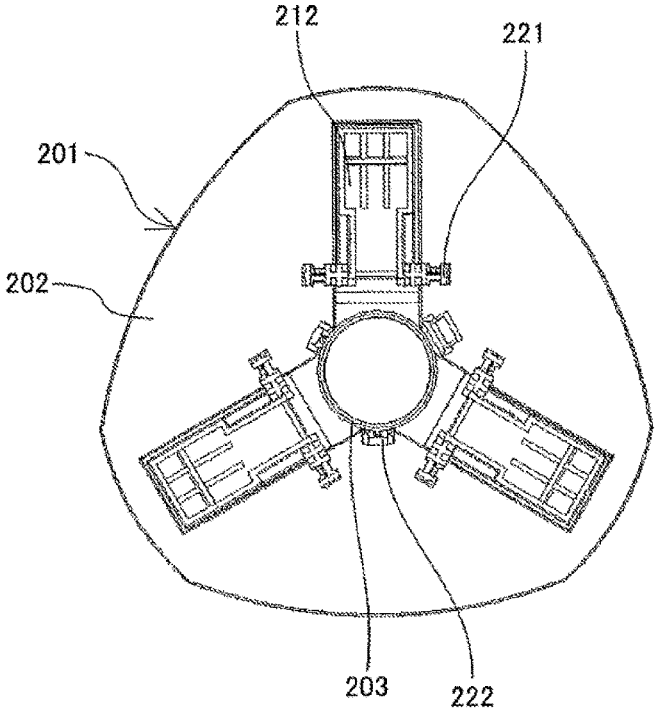
FIG. 8 is a front diagram illustrating a second supporting member of the roll retainer according to the first embodiment.

Next, a description is given, with reference to FIGS. 4 to 7, of a roll retainer according to a first embodiment. FIG. 4 is a perspective diagram illustrating the roll retainer when retaining a roll having a first inner diameter, FIG. 5 is a perspective diagram illustrating the roll retainer when retaining a roll having a second inner diameter, and FIG. 6 is a cross-sectional diagram illustrating the roll retainer when retaining the roll having the second inner diameter. FIG. 7 is a cross-sectional diagram illustrating a first supporting member, and FIG. 8 is a front diagram illustrating a second supporting member. Note that hatching is omitted from the cross-sectional diagram.

Note that in the following, the roll having the first inner diameter may also be referred to as a "roll having a small diameter", and the roll having the second inner diameter greater than the first inner diameter may also be referred to as a "roll having a large diameter". Further, the inner diameter indicates an inner diameter of the hollow shaft of the roll. The hollow shaft is formed of a cardboard tube, or the like, but the hollow shaft includes a hollow part without having a tube member or a core tube.

The roll retainer includes a retaining member 201 configured to be fit into an end part of the roll 112. The retaining member 201 includes a flange 202 facing an end face of the roll 112, and a hollow boss part 203 inserted into the hollow shaft 114 of the roll 112. The boss 203 is provided with a not-illustrated spool.

The retaining member 201 further includes a first supporting member 211 inserted into the hollow shaft of the roll 112 for retaining the roll having the first inner diameter, and second supporting members 212 inserted into the hollow shaft of the roll 112 for retaining the roll having the second inner diameter that is greater than the first inner diameter.

The first supporting member 211 is fit into the boss part 203 of the retaining member 201 such that the first supporting member 211 is movable in an axial direction. The boss part 203 is, as illustrated in FIG. 7, provided with guide parts 222 configured to guide the first supporting member such that the supporting member 211 is moved in the axial direction without rotating. Note that the "axial direction" or a "shaft direction" indicates an axial direction of the hollow shaft for retaining the roll unless otherwise specified.

The second supporting members 212 (in this example, the number of second supporting members is three, but not limited to three) are disposed at equal intervals around the boss part 203. Rear ends of the second supporting members 212 are pivotally supported (retained) by the flange 202 with respective shafts 221. As a result, each of the second supporting members 212 is movable between a supporting position and a retracted position along the axial direction within an inner surface. The supporting position is located at an outer periphery of the first supporting member 211 at which the second supporting members 212 are inserted into the hollow shaft of the roll 112 having the second inner diameter. The retracted position indicates a position at which the second supporting members 212 are retracted toward the flange 202 side illustrated in FIG. 4 from the supporting position.

The second supporting members 212 moved toward retracted positions are housed in the flange 202 so that the second supporting members 212 are not in contact with the end of the roll 112.

The rotatable shafts 221 for the supporting members 212 are, as illustrated in FIG. 8, disposed in directions orthogonal (perpendicular) to the axial direction of the boss part 203. Accordingly, the second supporting members 212 may turn around an axis line of the direction orthogonal to the axial direction.

Further, the first supporting member 211 and the second supporting members 212 are coupled via linking members (links) 213.

The links 213 are pivotally coupled to the second supporting members 212 via respective shafts 223 at respective positions closer toward middle parts of the second supporting members 212, and are also pivotally coupled to an end part of the first supporting member 211 via respective shafts 224 on the side end of the flange.

That is, the second supporting members 212 are coupled to one another via the respective links 213 and the first supporting member 211 coupled to the links 213.

Figure 9:
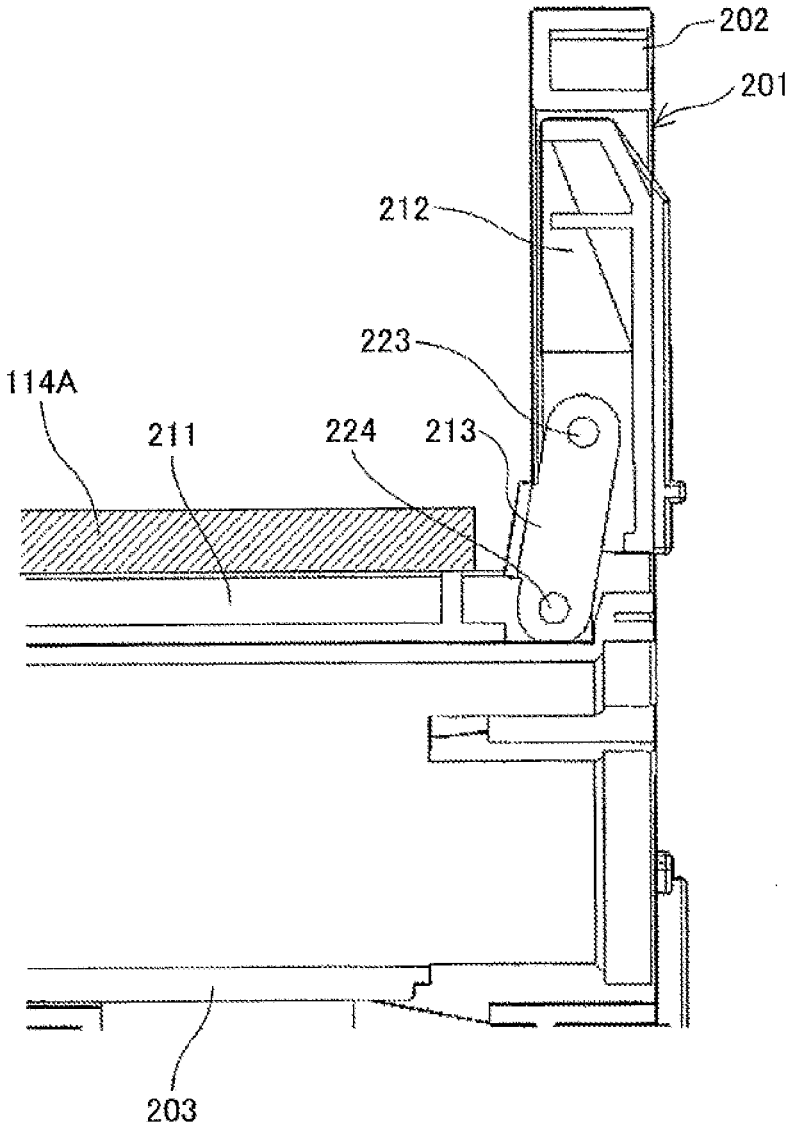
FIG. 9 is a cross-sectional diagram illustrating an effect provided by the roll retainer according to the first embodiment when retaining the roll having the first inner diameter.
Figure 10:
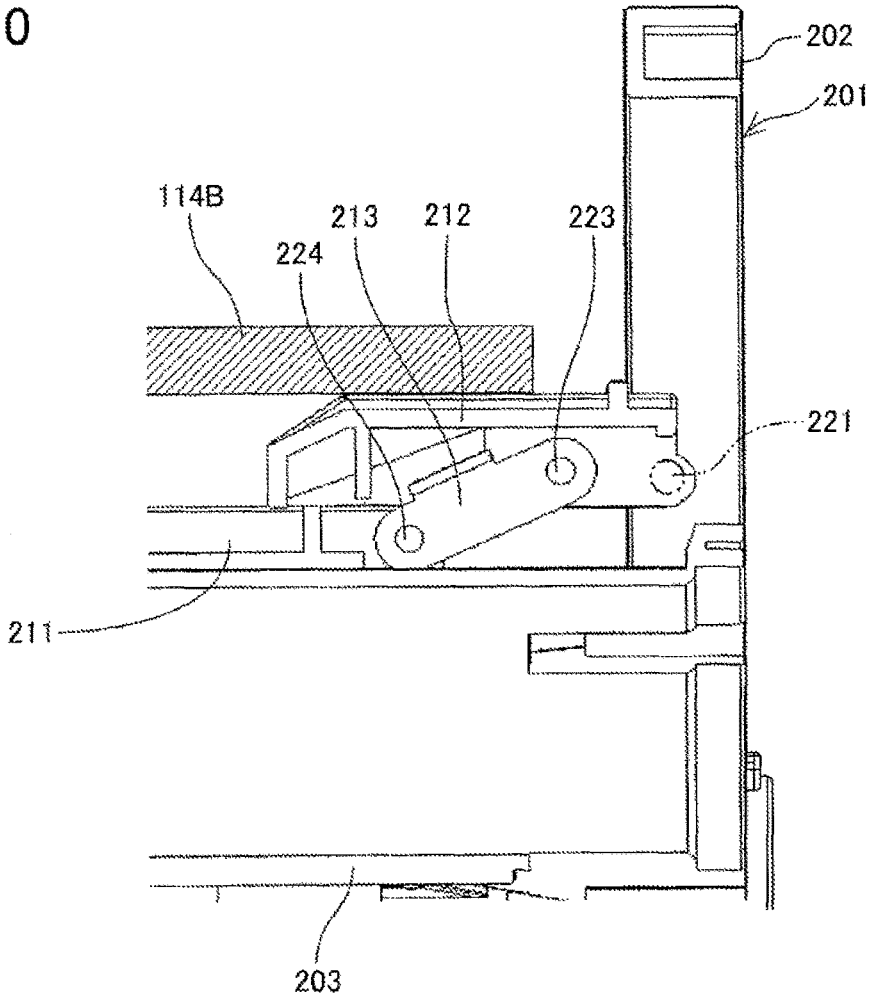
FIG. 10 is a cross-sectional diagram illustrating an effect provided by the roll retainer according to the first embodiment when retaining the roll having the second inner diameter.

An illustration is given, with reference to FIGS. 9 and 10, of effects of the roll retainer of this embodiment having the above-described configuration. FIG. 9 is a cross-sectional diagram illustrating the roll retainer retaining the roll having the first inner diameter, and FIG. 10 is a cross-sectional diagram illustrating the roll retainer retaining the roll having the second inner diameter.

When the roll retainer retains the roll having the first inner diameter, the second supporting members 212 are detached from the outer periphery of the first supporting member as illustrated in FIG. 4, and the detached second supporting members 212 are housed inside the flange 202 at their retracted positions.

Hence, as illustrated in FIG. 9, the first supporting member 211 is inserted into the hollow shaft 114A of the roll having the first inner diameter so that the roll having a small diameter is retained by the retaining member 201.

Further, to retain the roll having the second inner diameter, the second supporting members 212 are moved to respective supporting positions by being turned toward the outer periphery of the first supporting member 211 as illustrated in FIGS. 5 and 6.

Accordingly, as illustrated in FIG. 10, the second supporting members 212 are inserted into the hollow shaft 114B of the roll having the second inner diameter so that the roll having a large diameter is retained by the retaining member 201.

Note that the second supporting members 212 are linked together and moved to the supporting positions via the links 213 and the first supporting member 211 by operating one of the second supporting members 212 to be moved from the retracted position to the supporting position. Similarly, the second supporting members 212 are configured to be linked together and moved to the retracted positions via the links 213 and the first supporting member 211 by operating one of the second supporting members 212 to be moved from the supporting position to the retracted position.

With this configuration, the second supporting members 212 are moved to the retracted positions and also to the supporting positions without skipping any of the second supporting members 212 so as to allow the roll retainer to retain the rolls having different diameters.

Figure 11:
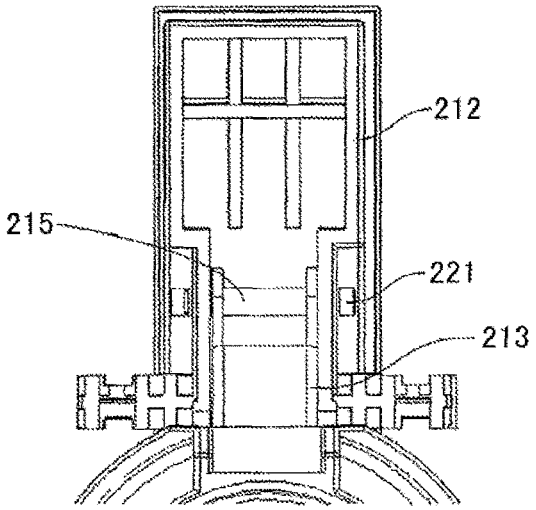
FIG. 11 is a front diagram illustrating a main part of a roll retainer according to a second embodiment.
Figure 12:
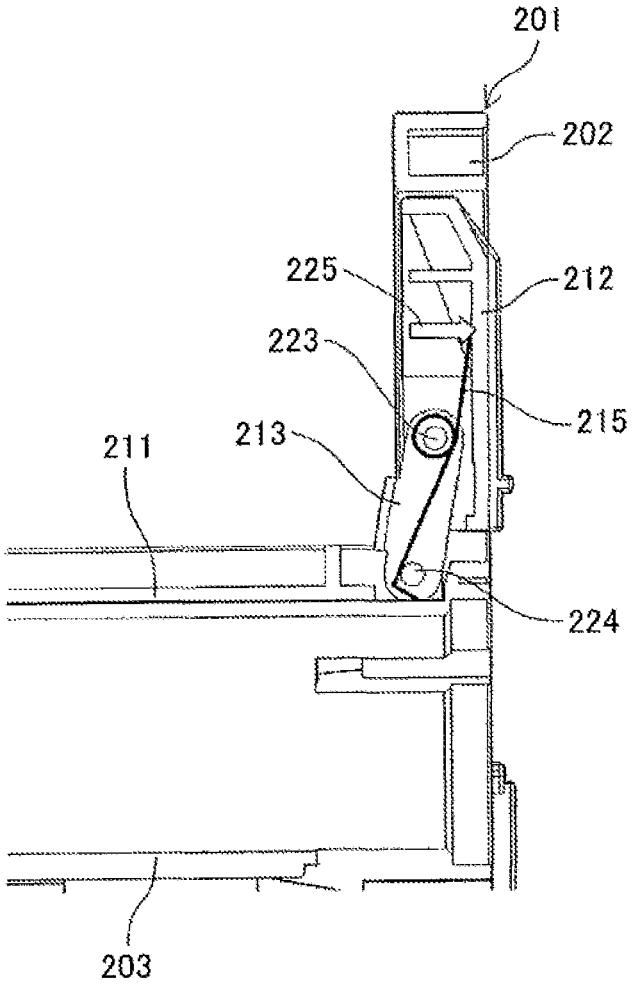
FIG. 12 is a side-sectional diagram illustrating the main part of the roll retainer according to the second embodiment.

Next, a description is given, with reference to FIGS. 11 and 12, of a roll retainer according to a second embodiment. FIG. 11 is a front diagram illustrating a main part of the roll retainer according to the second embodiment, and FIG. 12 is a sectional side diagram illustrating the main part of the roll retainer according to the second embodiment.

In the roll retainer of the second embodiment, a helical torsion spring 215 is disposed near the corresponding shaft 223 that couples between the second supporting member 212 and the link 213. The helical torsion spring 215 is configured to apply force to the second supporting member in a direction (indicated by an arrow 225) toward the retracted position inside the flange 212.

As a result, the second supporting members 212 moved toward the retracted positions are housed in the flange 202 so that the second supporting members 212 are not in contact with the end of the roll 112. Further, when the roll retainer of the second embodiment retains the roll having the second inner diameter, the pressure is applied toward directions to expand a diameter of the hollow shaft 114B inside the hollow shaft 114B. Hence, the roll having the second inner diameter may be retained tightly despite the fact that the diameter of the hollow shaft 114 has variability to some extent.

Figure 13:
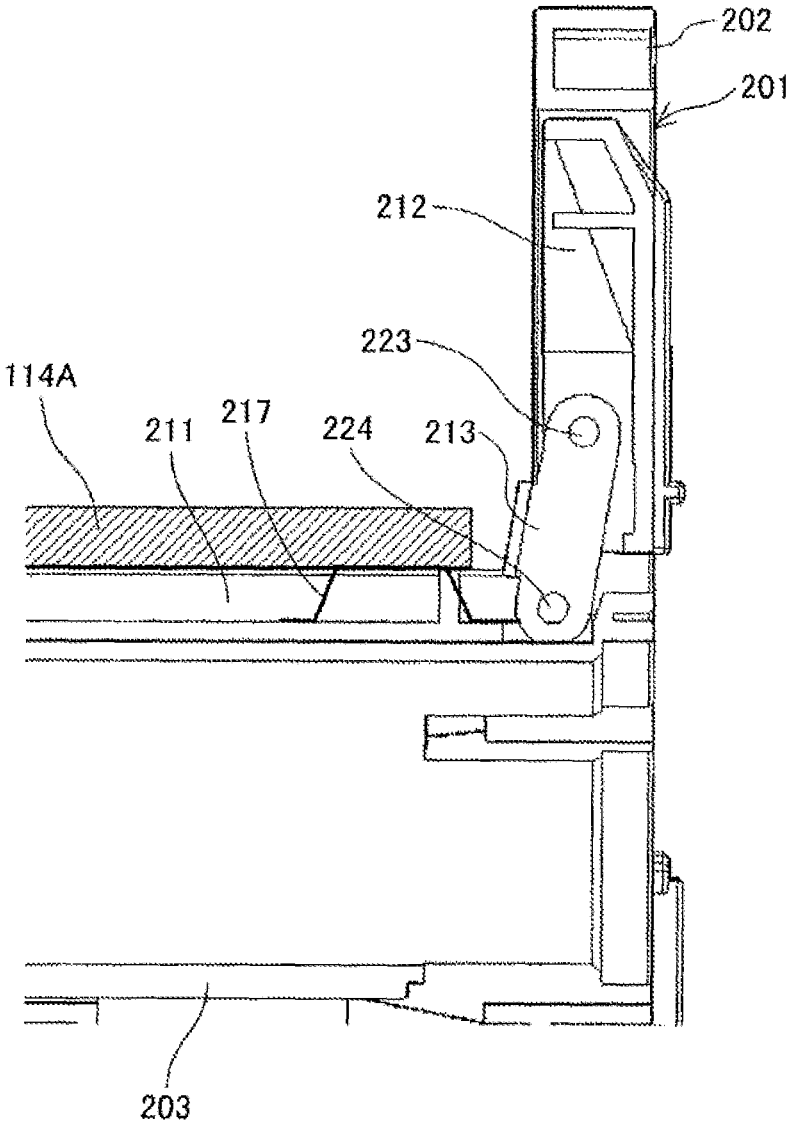
FIG. 13 is a cross-sectional diagram illustrating a roll retainer according to a third embodiment when retaining a roll having a small diameter (the first inner diameter)
Figure 14:
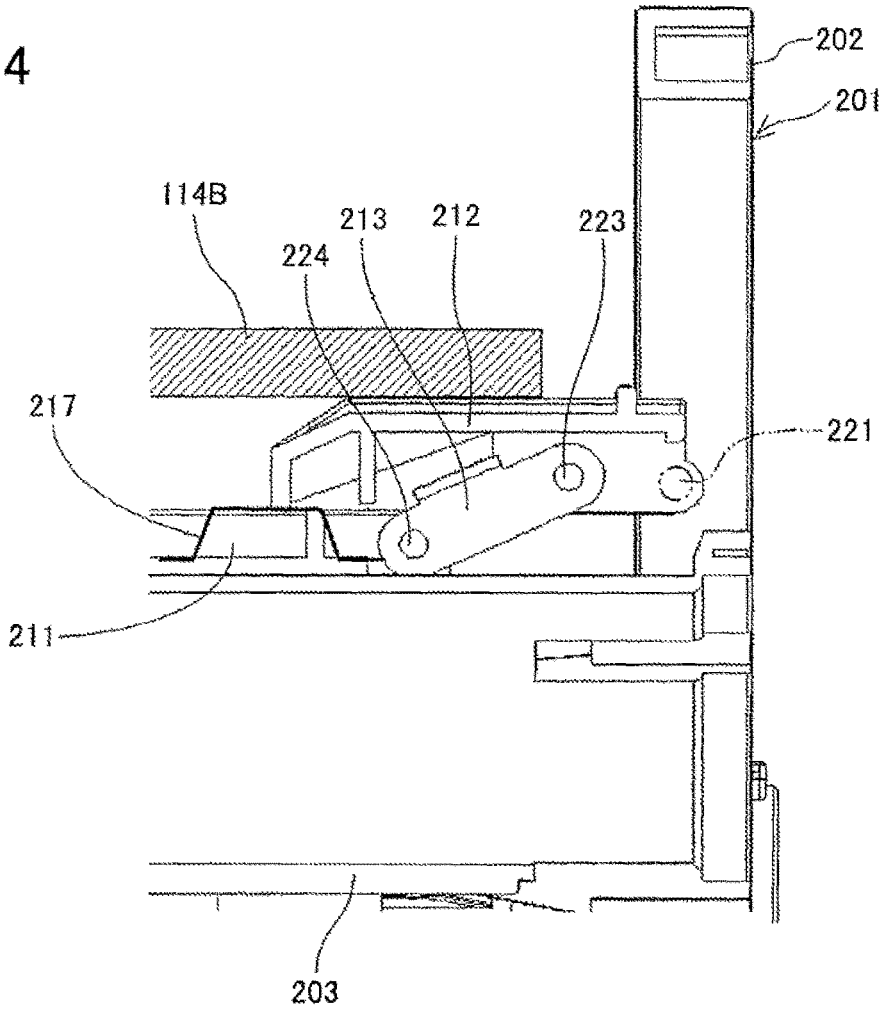
FIG. 14 is a cross-sectional diagram illustrating the roll retainer according to the third embodiment when retaining a roll having a large diameter (the second inner diameter)

Next, a description is given, with reference to FIGS. 13 and 14, of a roll retainer according to a third embodiment. FIG. 13 is a cross-sectional diagram illustrating the roll retainer retaining the roll having the small diameter, and FIG. 14 is a cross-sectional diagram illustrating the roll retainer retaining the roll having the large diameter.

In the roll retainer of the third embodiment, an elastic member 217 is provided around the outer periphery of the first supporting member 211 such that the elastic member 217 is projected from the outer peripheral surface of the first supporting member 211.

Thus, as illustrated in FIG. 13, when the first supporting member 211 is inserted into the hollow shaft 114A of the roll having the first inner diameter, the hollow shaft 114A of the roll directly compresses the elastic member 217 projected from the outer periphery of the first supporting member 211 such that the inner periphery of the hollow shaft 114A of the roll is pressed outward in a radial direction.

Further, as illustrated in FIG. 14, when the second supporting members 212 are moved at the supporting positions to retain the roll having the large diameter, the second supporting members 212 compress the elastic member 217 projected from the outer periphery of the first supporting member 211 such that the second supporting members 212 are pressed outward in a radial direction, and the inner periphery of the hollow shaft 114B of the roll having the second inner diameter is pressed outward in a radial direction.

Hence, the retaining member 201 is able to enhance the retaining ability to retain the roll.

Figure 15:
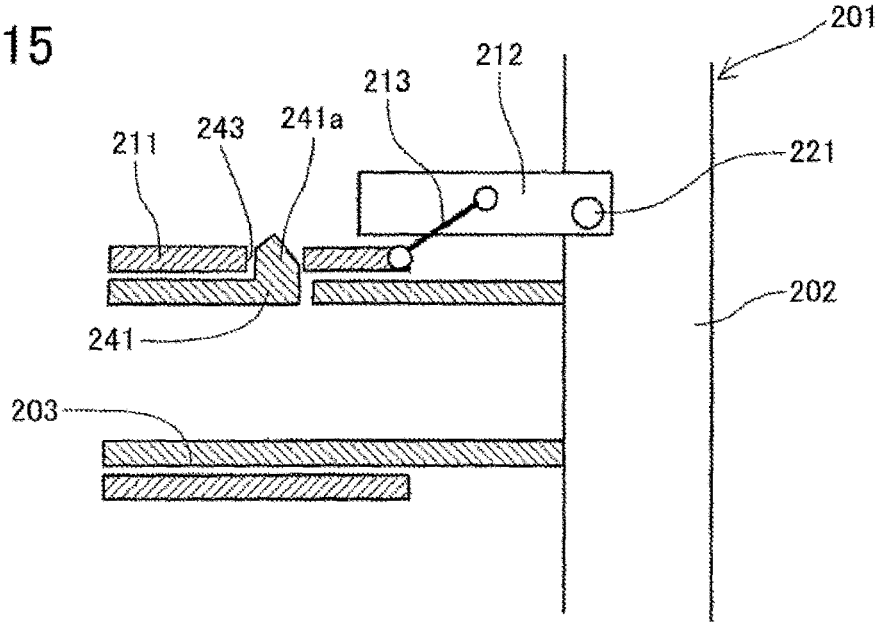
FIG. 15 is a cross-sectional diagram viewed from a main part illustrating a locking mechanism of a roll retainer according to a fourth embodiment when retaining the roll having the large diameter.
Figure 16:
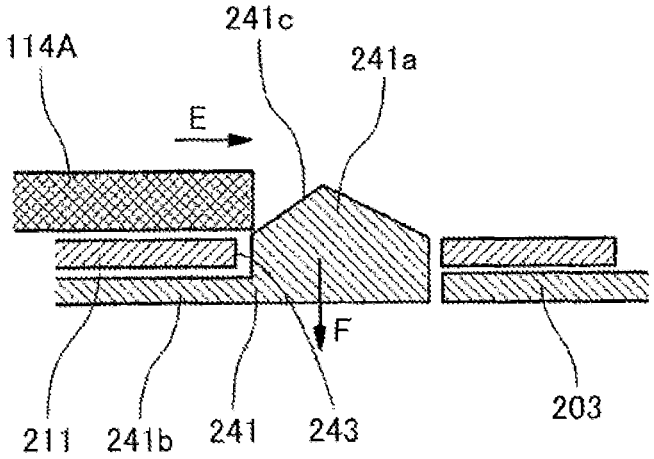
FIG. 16 is a cross-sectional diagram viewed from the main part illustrating an effect provided by the locking mechanism of the roll retainer according to the fourth embodiment.
Figure 17:
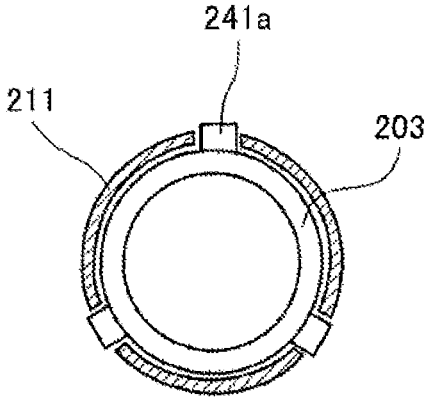
FIG. 17 is a sectional front diagram the locking mechanism of the roll retainer according to the fourth embodiment.

Next, a description is given, with reference to FIGS. 15 to 17, of a roll retainer according to a fourth embodiment. FIG. 15 is a sectional front diagram illustrating a locking mechanism in a main part of the roll retainer of the fourth embodiment when retaining the roll having the large diameter, FIG. 16 is a sectional side diagram illustrating an effect of the locking mechanism in the main part of the roll retainer, and FIG. 17 is a sectional front diagram illustrating the locking mechanism in the main part of the roll retainer.

The roll retainer of the fourth embodiment includes a locking member 241 configured to lock the corresponding second supporting member 212 at the supporting position, and unlock the corresponding second supporting member 212 when the first supporting member 211 is inserted into the hollow shaft of the roll having the first inner diameter.

The locking member 241 includes a locking claw 241*a* to be hooked onto a cutting part 243 of the first supporting member 211. The locking claw 241*a* is formed at an end of an elastically deformable supporting piece 241*b* formed by cutting a part of the boss part 203.

When the locking claw 241*a* of the locking member 241 enters the cutting part 243 of the first supporting member 211, and is hooked onto the cutting part 243 of the first supporting member 211, the first supporting member 211 is disabled from being moved from the supporting position of the second supporting member 212.

Further, the locking claw 241*a* of the locking member 241 includes a slope surface 241*c* elevated toward the outer peripheral surface of the flange 202.

With this configuration, as illustrated in FIG. 15, when the second supporting members 212 are moved to the supporting positions, the locking claws 241*a* of the locking members 241 are hooked onto the cutting parts 243 of the first supporting member 211, such that the second supporting members 212 are locked at the supporting positions by disabling the first supporting member 211 from being moved in the shaft center direction.

In this state, when the first supporting member 211 is inserted into the hollow shaft 114A of the roll having the first inner diameter, the hollow shaft 114A is relatively moved toward an arrow E direction with respect to the locking claw 241*a*, and hence, the locking member 241 is pushed in a radial direction toward the shaft center (an arrow F direction) to be detached from the cutting part 243.

Accordingly, the first supporting member 211 is unlocked to become movable in the shaft center direction of the boss part 203. Then, the second supporting members 212 are pivotally moved to the retracted positions on the flange 202 side according to the movement of the first supporting member 211 along with the insertion of the roll having the first inner diameter. In this case, the helical torsion springs 215 illustrated in the second embodiment may be provided such that the second supporting members 212 are pivotally moved to the retracted positions more quickly.

As described above, in this configuration, the second supporting members are unlocked to be moved to the retracted positions by inserting the first supporting member into the hollow shaft of the roll. Hence, it is possible to switch the positions of the second supporting members so as to change the roll having the large diameter to the roll having the small diameter by simply inserting the roll having the small diameter.

Figure 18:
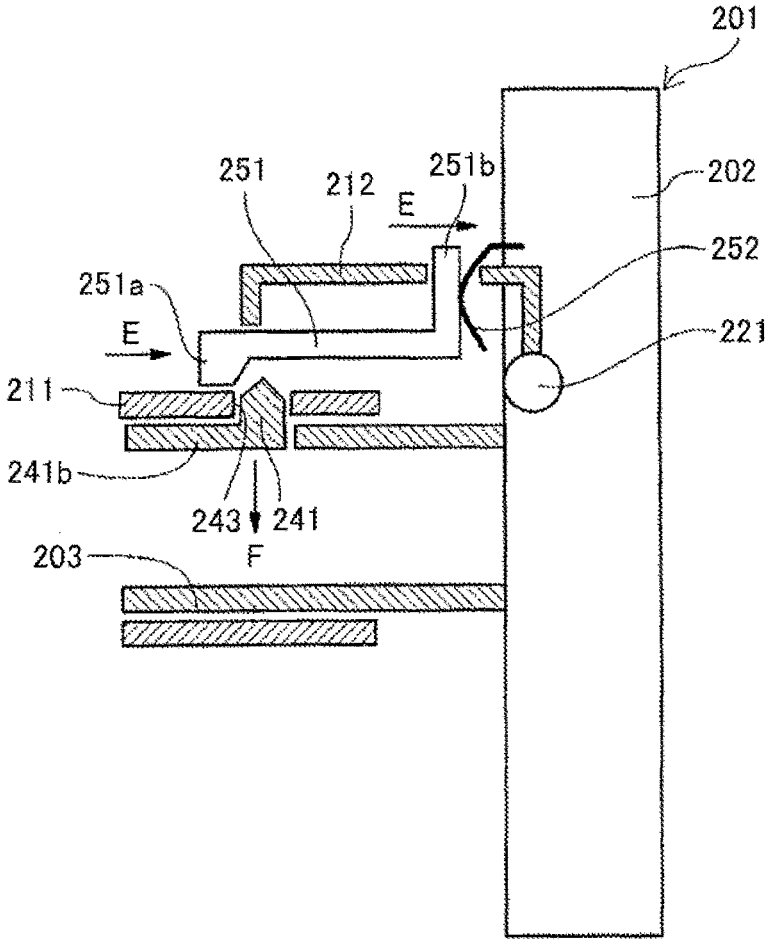
FIG. 18 is a cross-sectional diagram viewed from a main part illustrating a locking mechanism of a roll retainer according to a fifth embodiment when retaining the roll having the large diameter.
Figure 19:
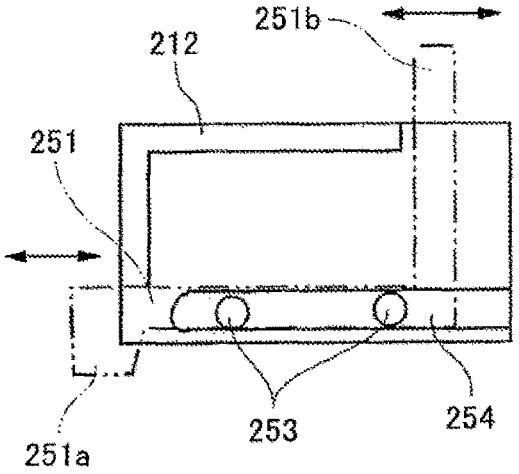
FIG. 19 is a sectional side diagram illustrating a second supporting member of the roll retainer according to the fifth embodiment.
Figure 20:
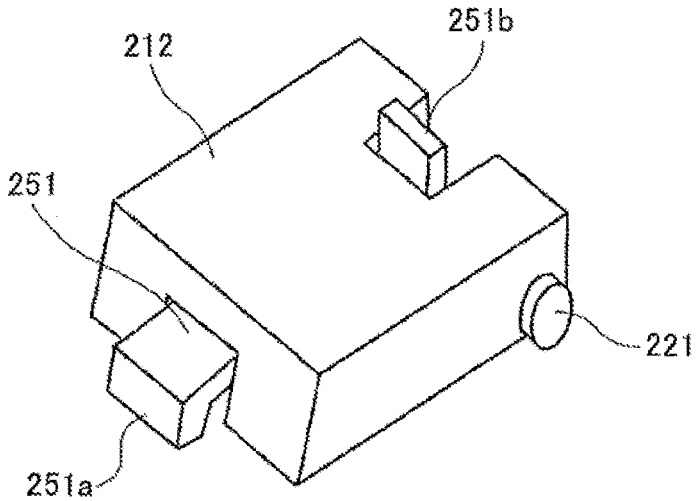
FIG. 20 is a perspective diagram illustrating the second supporting member of the roll retainer according to the fifth embodiment.

Next, a description is given, with reference to FIGS. 18 to 20, of a roll retainer according to a fifth embodiment. FIG. 18 is a sectional side diagram illustrating a locking mechanism of the roll retainer, FIG. 19 is a sectional side diagram illustrating a second supporting member, and FIG. 20 is a perspective diagram illustrating the second supporting member.

The roll retainer of the fifth embodiment includes a locking member 241 configured to hook onto the cutting part 243 of the first supporting member 211 to regulate the movement of the first supporting member 211 in a manner similar to that of the fourth embodiment.

On the other hand, each of the second supporting members 212 is provided with an unlocking member 251 movably disposed in the shaft center direction (direction indicated by arrows in FIG. 19). The unlocking member 251 is provided with projections 253 guided and supported in grooves 254 formed in the second supporting member 212, as illustrated in FIG. 19.

The second supporting member 212 is provided with an elastic member 252 configured to press the unlocking member 251 in a direction departing from the flange 202.

The unlocking member 251 includes a releasing part 251*a* configured to push the locking member 241 in an arrow F direction by being pushed in an arrow E direction when inserted into the hollow shaft of the roll having the first inner diameter, and an arm 251*b* configured to be pushed when inserted into the roll having the second inner diameter.

The releasing part 251*a* of the unlocking member 251 also moves to a position to push the locking member 241 in the arrow F direction when the arm 251*b* is pushed by the hollow shaft of the roll having the second inner diameter.

In this configuration, when the roll retainer retains the roll having the second inner diameter, each of the second supporting members 212 is moved to the supporting position to lock the first supporting member 211, which then locks the second supporting members at the supporting positions, as illustrated in FIG. 18.

In this condition, when the hollow shaft of the roll having the second inner diameter is fit onto the outer peripheries of the second supporting members 212, the arms 251*b* of the unlocking members 251 are pushed toward the flange 202. Hence, the releasing parts 251*a* of the unlocking members 251 are moved in the E directions to push down the locking members 241 to unlock the locking members 241.

As a result, the second supporting members 212 expand by restoration force of the not-illustrated helical torsion springs, and the expanded second supporting members 212 are pressed to be in contact with the inner peripheral surface of the hollow shaft, which increases retainability of the hollow shaft. In addition, when inserting the roll having the second inner diameter, the second supporting members 212 are locked, thereby facilitating insertion of the roll having the second inner diameter to improve operability.

On the other hand, when the hollow shaft of the roll having the first inner diameter is fit onto the outer peripheries of the second supporting members 212, the unlocking members 251 are pushed in the arrow E direction to push down the lock members 241 in the arrow F direction, thereby unlocking the locking members 241 in a similar manner.

As a result, the first supporting member 211 is movable in the shaft center direction of the boss part 203 to turn the second supporting members 212 to be moved to the retracted positions toward the flange 202.

Accordingly, the first supporting member is simply inserted into the hollow shaft of the roll to move the second supporting members to be located at the retracted positions, thereby facilitating positional switching of the second supporting members for changing the roll having the large diameter into the roll having the small diameter, in a manner similar to the fourth embodiment.

Figure 21:
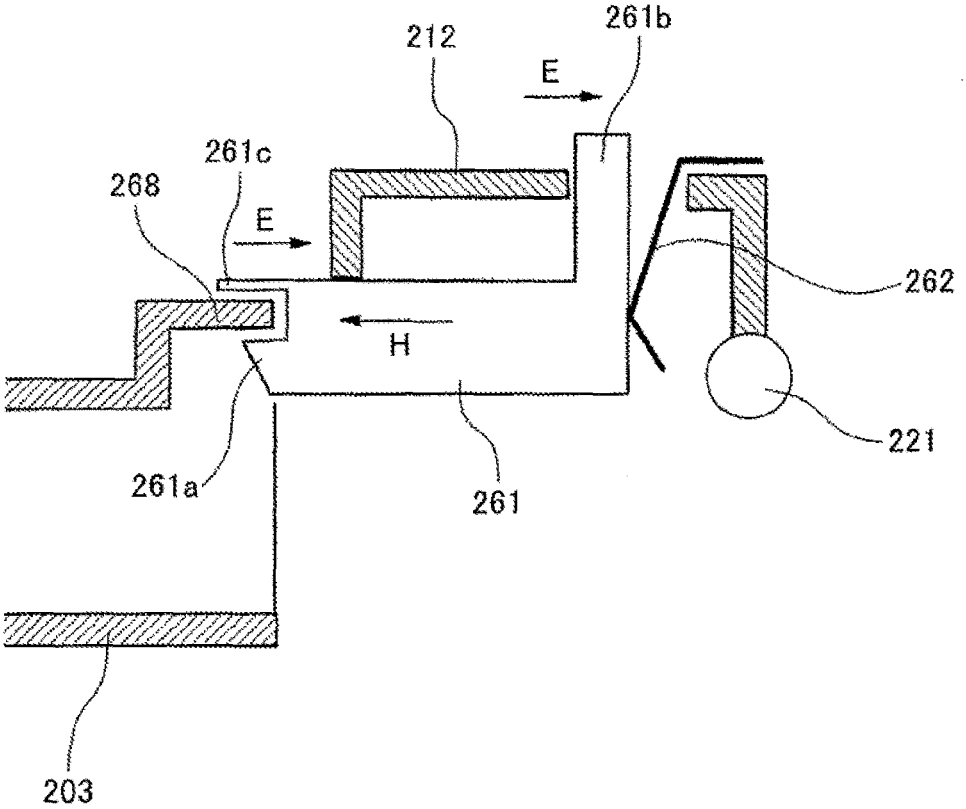
FIG. 21 is a cross-sectional diagram illustrating a locking mechanism of a roll retainer according to a sixth embodiment when retaining the roll having the large diameter.
Figure 22:
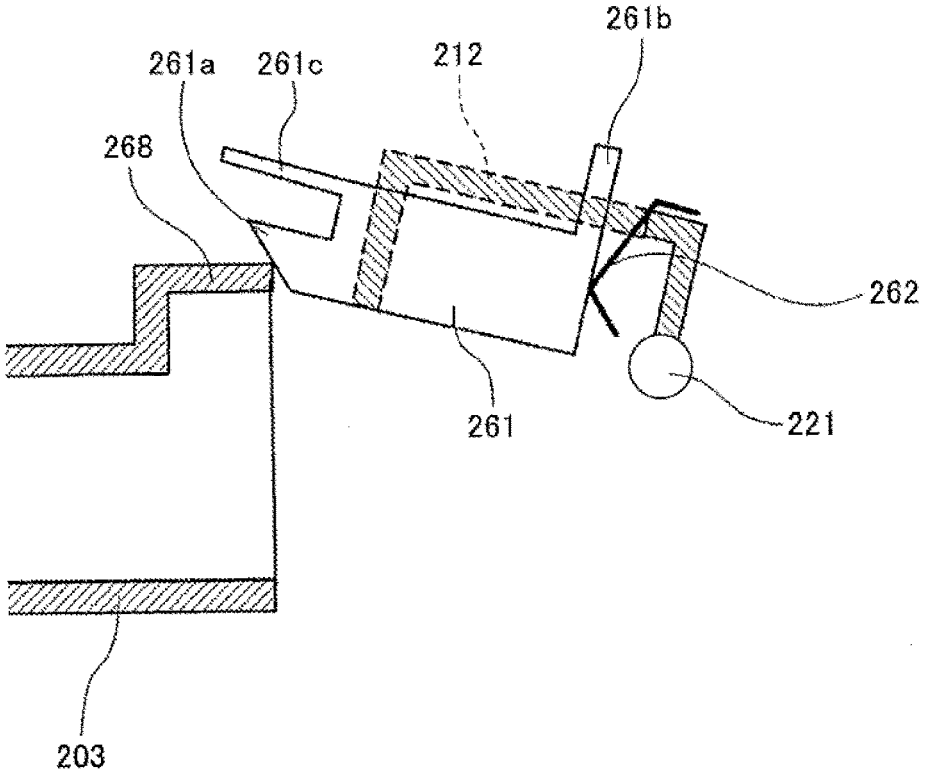
FIG. 22 is a cross-sectional diagram viewed from a main part illustrating the roll retainer according to the sixth embodiment when retaining the roll having the small diameter.
Figure 23:
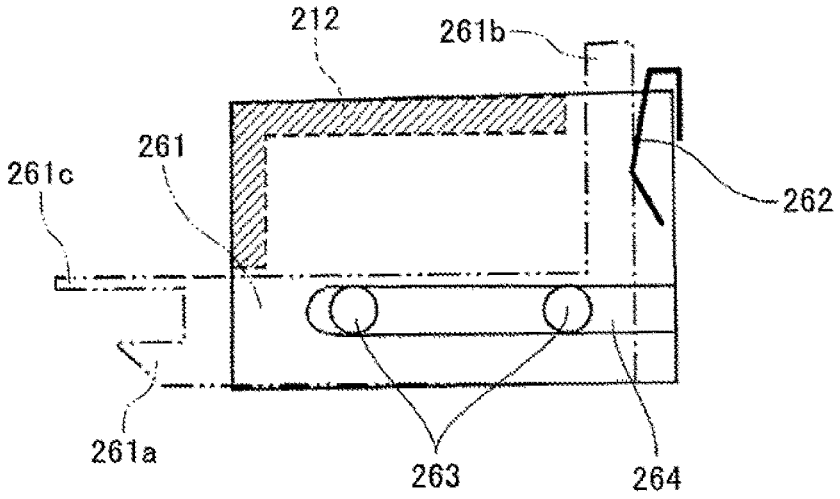
FIG. 23 is a sectional side diagram illustrating a second supporting member of the roll retainer according to the sixth embodiment.

Next, a description is given, with reference to FIGS. 21 to 23, of a roll retainer according to a sixth embodiment. FIG. 21 is a sectional side diagram illustrating a locking mechanism of a main part of the roll retainer when retaining the roll having the large diameter, FIG. 22 is a sectional side diagram illustrating the locking mechanism of the main part of the roll retainer when retaining the roll having the small diameter, and FIG. 23 is a sectional side diagram illustrating the second supporting member.

Each of the second supporting members 212 is provided with a locking member 261 disposed movably in the shaft center direction. Each of the locking members 261 is provided with projections 263 guided and supported in grooves 264 formed in the corresponding second supporting member 212, as illustrated in FIG. 23.

The second supporting member 212 is provided with an elastic member 262 configured to press the locking member 261 in a direction departing from the flange 202.

The locking member 261 includes a locking claw 261*a* configured to be hooked on an insertion port 268 of the first supporting member 211 when inserted into the insertion port 268 of the first supporting member 211. Further, the locking member 261 includes a contact part 261*c* configured to be brought into contact with the hollow shaft and pushed against the hollow shaft when the hollow shaft of the roll having the first inner diameter is fit to the roll retainer of the sixth embodiment. Moreover, the locking member 261 includes an arm 261*b* configured to be brought into contact with the hollow shaft and pushed against the hollow shaft when the hollow shaft of the roll having the second inner diameter is fit to the roll retainer of the sixth embodiment.

Then, when the arm 261*b* of the locking member 261 is pushed by the hollow shaft of the roll having the second inner diameter, the locking member 261 is moved to the position where the locking claw 261*a* departs from the insertion port 268.

In this configuration, as illustrated in FIG. 21, when the second supporting member 212 is located at the supporting position, the locking claw 261*a* of the locking member 261 is hooked onto the insertion port 268 of the first supporting member 211, and the locking claw 261*a* of the locking member 261 is pressed by the elastic member 262 in an arrow H direction. As a result, the second supporting member 212 is locked at the supporting position.

When the hollow shaft of the roll having the second inner diameter is fit onto the outer peripheries of the second supporting members 212, the arm 261*b* of the locking member 261 is pushed in the arrow E direction. Accordingly, the locking member 261 is moved toward the flange 202 to separate the locking claw 261*a* from the insertion port 268, thereby unlocking the locking member 261.

As a result, the second supporting members 212 expand by restoration force of the not-illustrated helical torsion springs, and the expanded second supporting members 212 are pressed to be in contact with the inner peripheral surface of the hollow shaft, which increases retainability of the hollow shaft.

On the other hand, when the hollow shaft of the roll having the first inner diameter is fit onto the outer peripheries of the second supporting members 212, the contact part 261*c* of the locking member 261 is pushed in the arrow E direction. Accordingly, the locking member 261 is moved toward the flange 202 to separate the locking claw 261*a* from the insertion port 268, thereby unlocking the locking member 261.

As a result, the first supporting member 211 is movable in the shaft center direction to turn the second supporting members 212 to be moved to the retracted positions toward the flange 202.

Accordingly, the first supporting member is simply inserted into the hollow shaft of the roll to move the second supporting members to be located at the retracted positions, thereby facilitating positional switching of the second supporting members for changing the roll having the large diameter into the roll having the small diameter, in a manner similar to that of the fourth embodiment.

Note that in the sixth embodiment, the illustration is given of the example of the configuration in which the roll having the small diameter is supported by the first supporting member movably fitting into the boss part. However, the configuration is not limited to this example. The configuration may include the first supporting member that is supported by the boss part of the retaining member, and the first supporting member may simply serve as a coupling device configured to couple two or more second supporting members. In such a case, the second supporting members serve as the supporting members, and the first supporting member may serve as a coupling member together with the links to form the coupling device.

Figure 24:
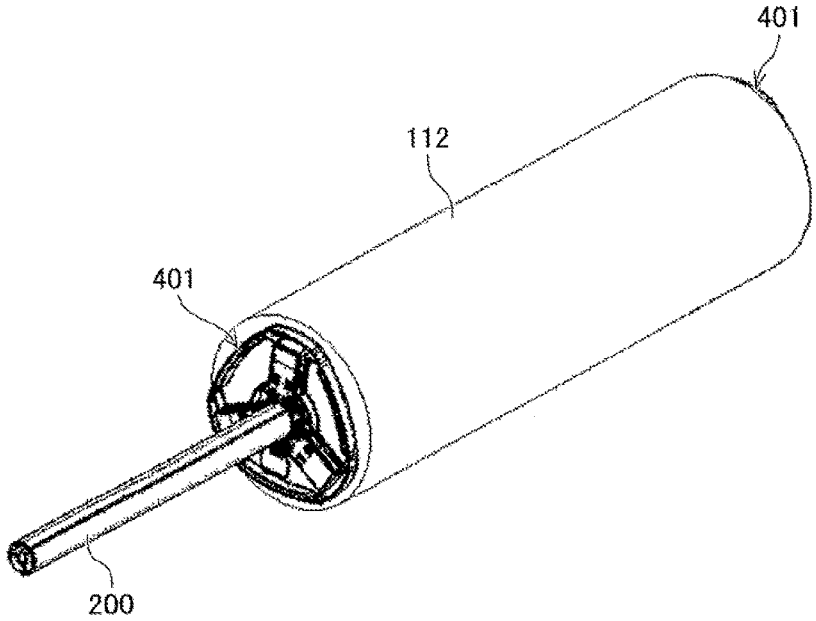
FIG. 24 is a perspective diagram illustrating a roll retainer according to a seventh embodiment that retains a roll.
Figure 25:
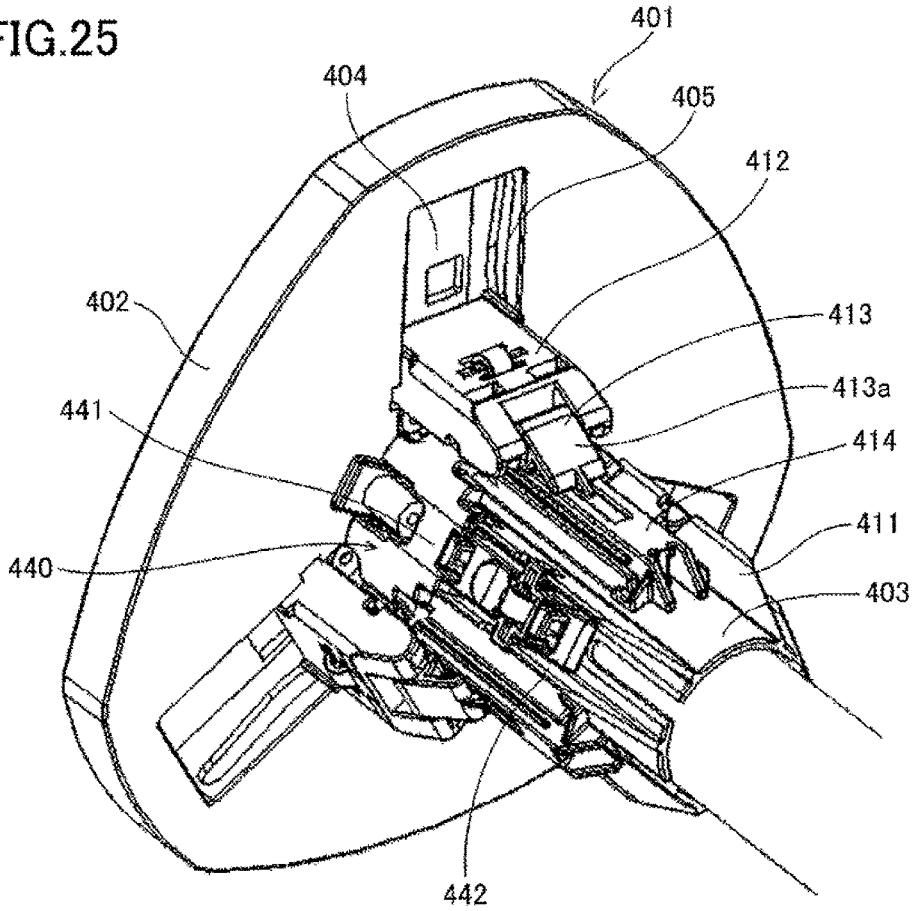
FIG. 25 is a perspective diagram illustrating the roll retainer according to the seventh embodiment when retaining the roll having the second inner diameter.
Figure 26:
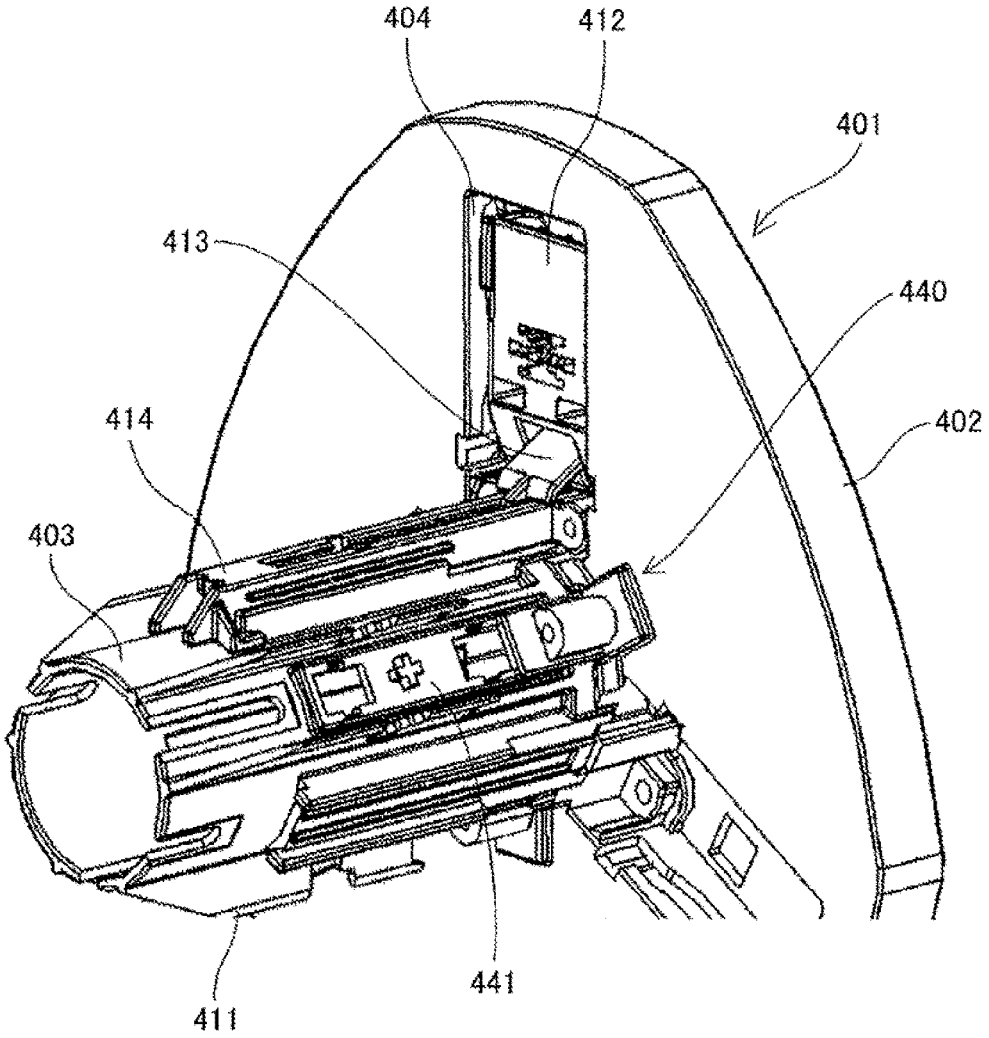
FIG. 26 is a perspective diagram illustrating the roll retainer according to the seventh embodiment that retains the roll having the first inner diameter.

Next, a description is given, with reference to FIGS. 24 to 26, of a roll retainer according to a seventh embodiment. FIG. 24 is a perspective diagram illustrating a roll retainer retaining a roll, FIG. 25 is a perspective diagram illustrating the roll retainer retaining the roll having the second inner diameter, and FIG. 26 is a diagram illustrating the roll retainer retaining the roll having the first inner diameter.

The roll retainer includes a retaining member 401 configured to be fit into an end part of the roll 112. As illustrated in FIG. 24, there are two types of the retaining members 401; a fixing-side retaining member 401 fixed to a spool 200, and a movable-side retaining member 401 movable in an axial direction (a direction the same as the axis direction or the shaft direction) of the spool 200. The fixing-side retaining member 401 is fixed to the spool 200; however, the movable-side retaining member 401 is movable in the axial direction of the spool 200 according to the size of the roll 112.

Each of the retaining members 401 includes a base 402 corresponding to the flange in the above-described embodiments facing the end of the roll 112, and a cylindrical shaft 403 corresponding to the hollow boss part in the above-described embodiments inserted into the hollow shaft 114 of the roll 112. The spool 200 passes through the cylindrical shaft 403.

Each of the retaining members 401 includes multiple (three, in this case) support switching members 412 movable in the axial direction. Each of the support switching members 412 is movable between a supporting position (a position illustrated in FIG. 25), at which the support switching members 412 support the roll 112 having the second inner diameter and a retracted position (a position illustrated in FIG. 26), at which the support switching members 412 are retracted and the retaining members 401 supports the roll having the first inner diameter.

The base 402 of the retaining member 401 includes receiving parts 404 configured to receive the respective support switching members 412 at the retracted positions. The base 402 of the retaining member 401 further includes guiderails 405 configured to regulate turning angles of the respective support switching members 412.

Each of the support switching members 412 is turned around the link 413, slides in the axial direction, and is housed in the receiving part 404 in the base 402 of the retaining member 401 in a direction in which the support switching member 412 is retracted in a short length in a thrust direction.

The cylindrical shaft 403 includes a hollow part into which the spool 200 is inserted, and guide ribs 411 configured to be brought into contact with the inner peripheral surface of the hollow shaft 114A of the roll having the first inner diameter so as to guide the hollow shaft 114A. Further, the cylindrical shaft 403 includes guiderails 414 configured to regulate slide positions of the support switching members 412, and guiderails 442 configured to regulate moving directions of the locking members 441.

The not-illustrated boss part of the support switching member 412 is attached to the guiderail 405, and also attached to the guiderail 414 via the link 413 pivotally supported on the later-described shaft 423 of the support switching member 412. The link 413 includes a taper part 413*a* for disperse load in the thrust direction applied when the retaining member 401 is fit (inserted) into the roll 112.

In this example, as illustrated in FIG. 25, the support switching members 412 are disposed at the supporting positions on the cylindrical shaft 403 such that the roll having the second inner diameter (e.g., 3-inch cardboard tube) is supported by the support switching members 412.

Further, as illustrated in FIG. 26, the support switching members 412 are retracted from the cylindrical shaft 403 and received in the receiving parts 404 at the retracted positions. As a result, the support switching members 412 support the roll having the first inner diameter (e.g., 2-inch cardboard tube) at the cylindrical shaft 403.

The locking members 441 forming the locking device (locking mechanism) 440 move along the guiderails 442 and are hooked on the support switching members 412 to stop the movements of the support switching members 412 configured to change the supporting size from the roll 112 having the second inner diameter to the roll 112 having the first inner diameter. Note that a detailed description is given later of the locking mechanism 440 including the locking members 441.

When the roll retainer in this embodiment is to fit into the roll 112 having the first inner diameter of 2 inches, the end face in the axial direction of the hollow shaft of the roll 112 is in contact with the taper parts 413*a* of the links 413. In this condition, the locking members 441 are ready to unlock the support switching members 412.

Accordingly, the links 413 slide in the axial direction, and the support switching members 412 turn and slide along the guiderails 405 to be seated in the receiving parts 404 of the base 402. Accordingly, the roll 112 having the first inner diameter is supported (retained) by the guide ribs 411 of the cylindrical shaft 403.

On the other hand, when the roll retainer in this embodiment is to fit into the roll 112 having the second inner diameter of 3 inches, the locking members 441 lock the support switching members 412. Hence, the support switching members 412 are retained at the supporting positions.

As a result, the support switching members 412 are inserted into the hollow shaft 114B of the roll 112 having the second inner diameter, and the roll 112 having the second inner diameter is retained by the support switching members 412.

Note that the cylindrical shaft 403 and the base of the retaining member 401 may be integrally formed or separately formed.

Figure 27:
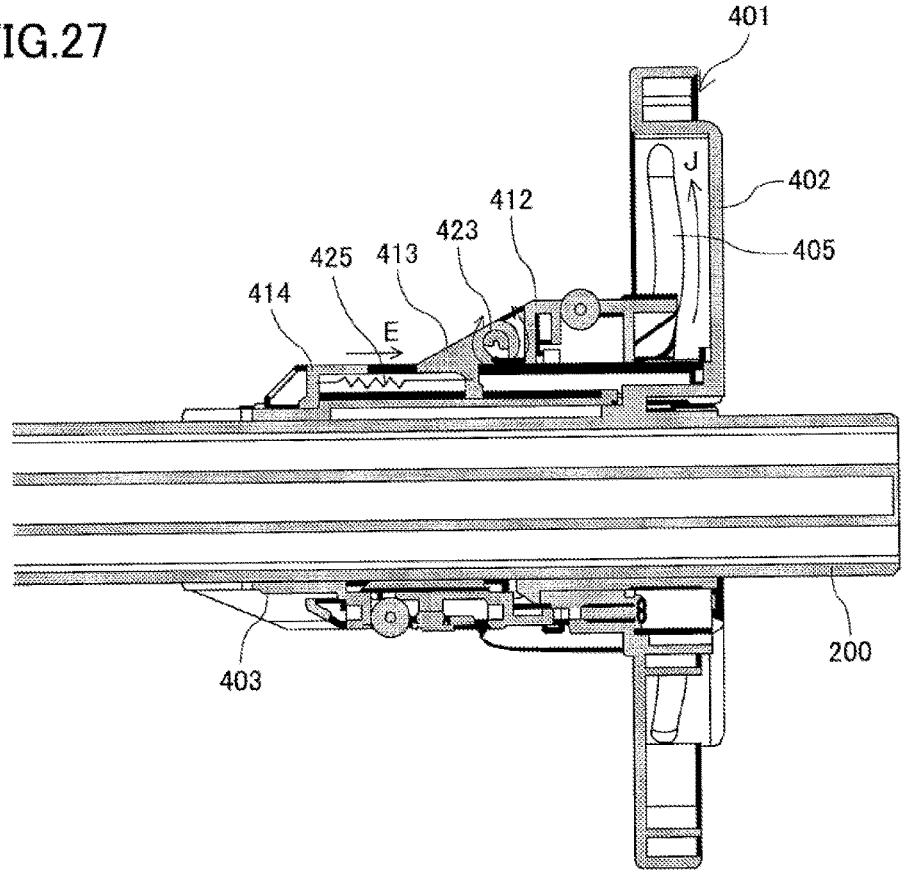
FIG. 27 is a cross-sectional diagram illustrating a retaining member relating to a moving mechanism of a support switching member in the roll retainer according to the seventh embodiment.

Next, a moving mechanism of the support switching member 412 is described with additional reference to FIG. 27. FIG. 27 is a cross-sectional diagram illustrating the moving mechanism of the roll retainer.

As described above, the base 402 of the retaining member 401 further includes the guide rails 405 configured to regulate the turning angles of the respective support switching members 412. Further, the cylindrical shaft 403 of the retaining member 401 is provided with the guiderails 414 configured to regulate the slide directions of the respective support switching members 412 in the axial direction.

A front end of each support switching member 412 includes the shaft 423, and the link 413 is pivotally attached to the shaft 423. The link 413 is attached to the guiderail 414. Further, the rear end (the side end of the base 402) of the support switching member 412 is movably attached to the guiderail 405.

In this configuration, the end face of the hollow shaft 114A of the roll 112 having the first inner diameter is brought into contact with the link 413 to push the link 413 relatively in the arrow E direction.

Accordingly, since the support switching member 412 turns around the shaft 423 as a fulcrum to move side end (the rear end) of the guiderail 405 in an arrow J direction orthogonal to the axial direction, the support switching member 412 turns and moves in the axial direction so as to be seated in the receiving part 404.

On the other hand, there is provided between the guiderail 414 and the link 413 an elastic member 425 deformable in the axial direction such as a tensile coil spring. The link 413 is applied with force by this elastic member 425 in a direction departing from the base 402 of the retaining member 401.

Accordingly, even though the support switching member 412 is moved to the retracted position, the support switching member 412 may be able to return to the supporting position at which the support switching member 412 supports the roll having the second inner diameter illustrated in FIG. 25 by elastic force (restoration force) of the elastic member 425 at the time the roll retainer is detached from the roll having the first inner diameter.

Figure 28:
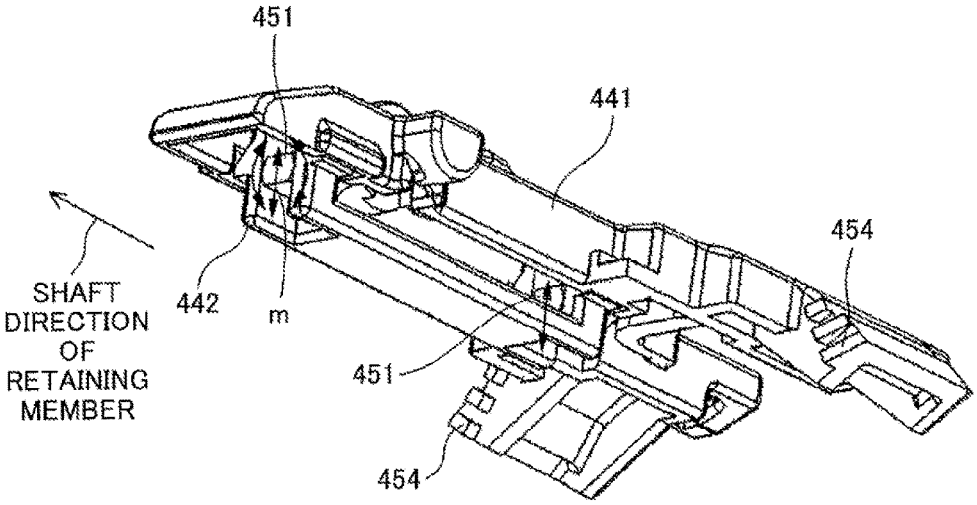
FIG. 28 is a perspective diagram illustrating a locking member of a locking mechanism serving as a locking device in the roll retainer according to the seventh embodiment.
Figure 29:
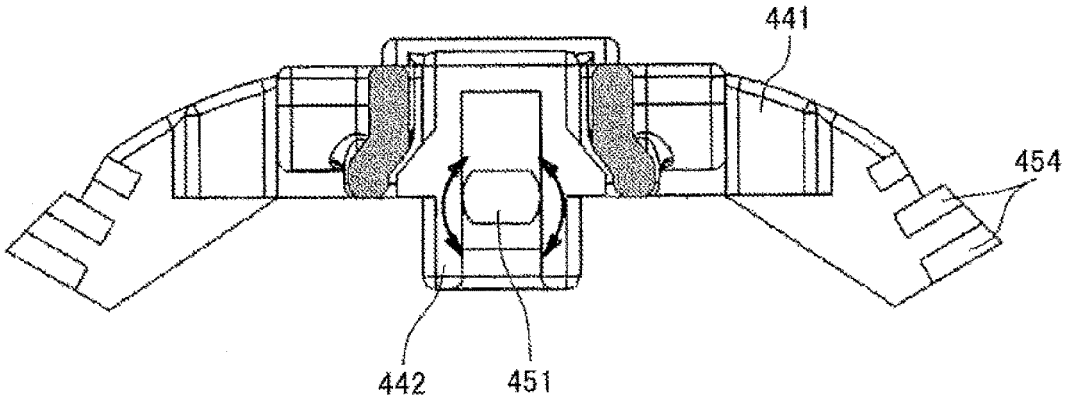
FIG. 29 is a front diagram illustrating the locking mechanism of the roll retainer according to the seventh embodiment.
Figure 30:
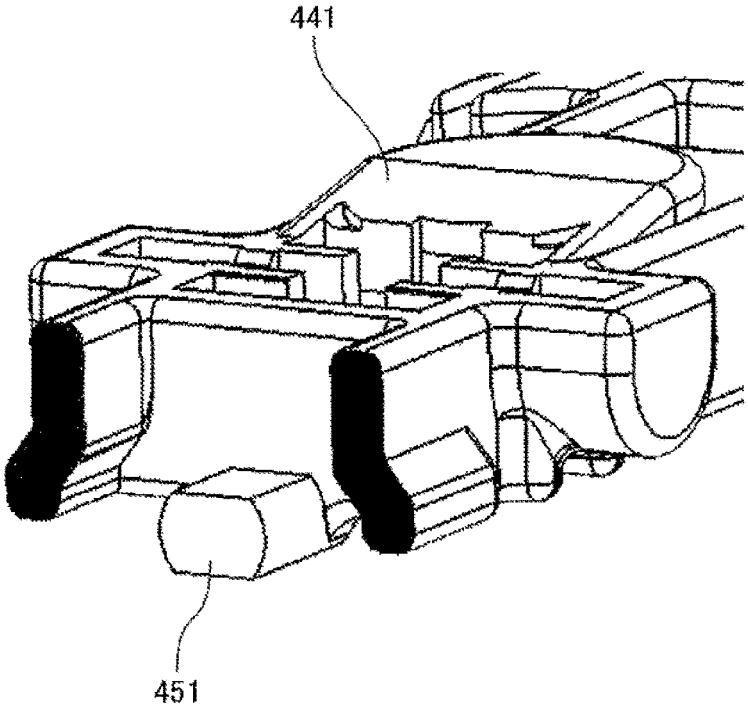
FIG. 30 is a perspective diagram illustrating a boss part of the locking mechanism.
Figure 31:
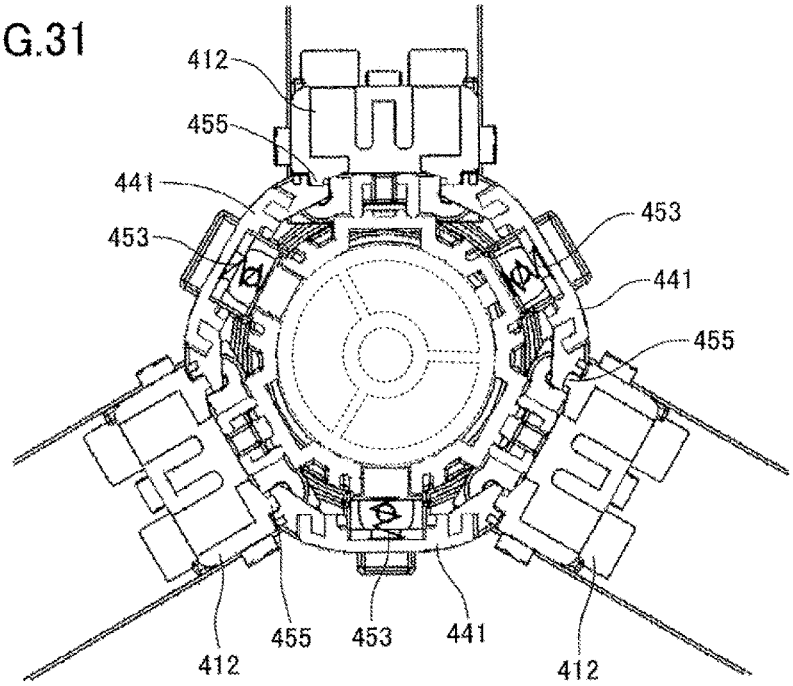
FIG. 31 is a sectional front diagram illustrating an engaging part of the locking mechanism.
Figure 32:
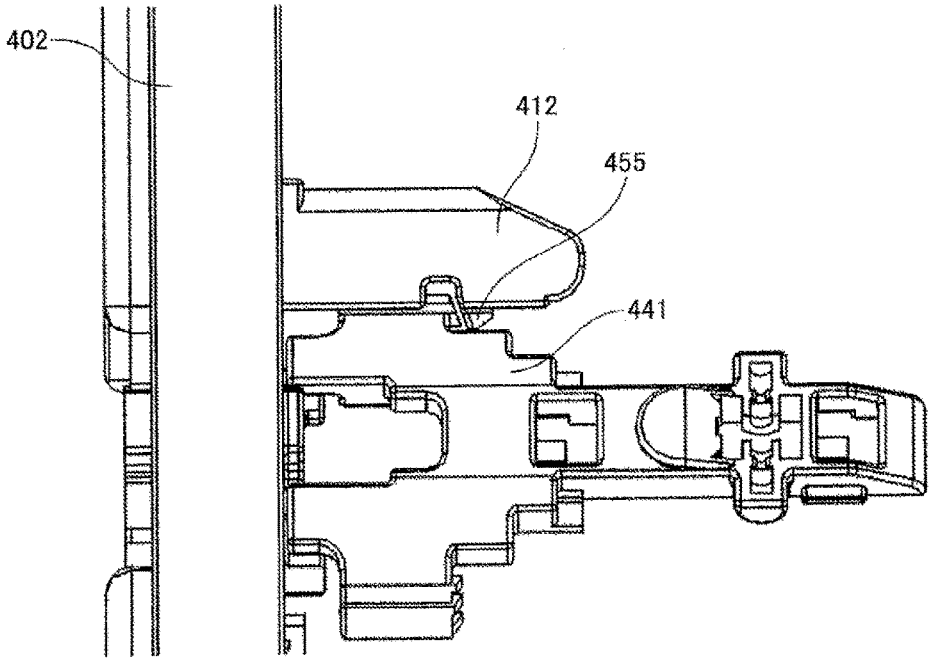
FIG. 32 is a sectional side diagram illustrating the engaging part of the locking mechanism.
Figure 33:
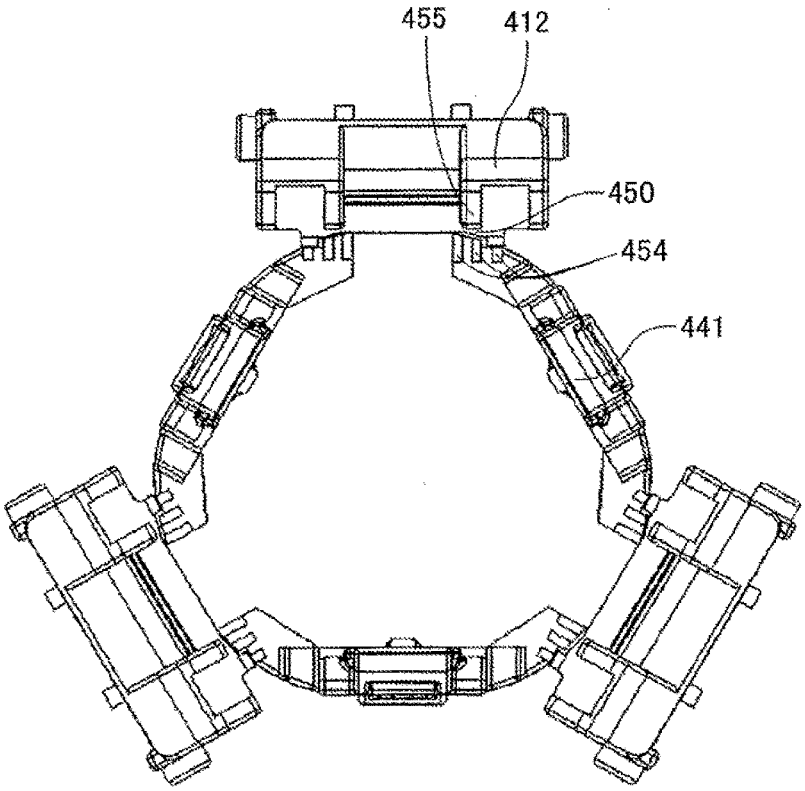
FIG. 33 is a diagram viewed from a shaft center of the roll when the locking mechanism is in an unlocked status.
Figure 34:
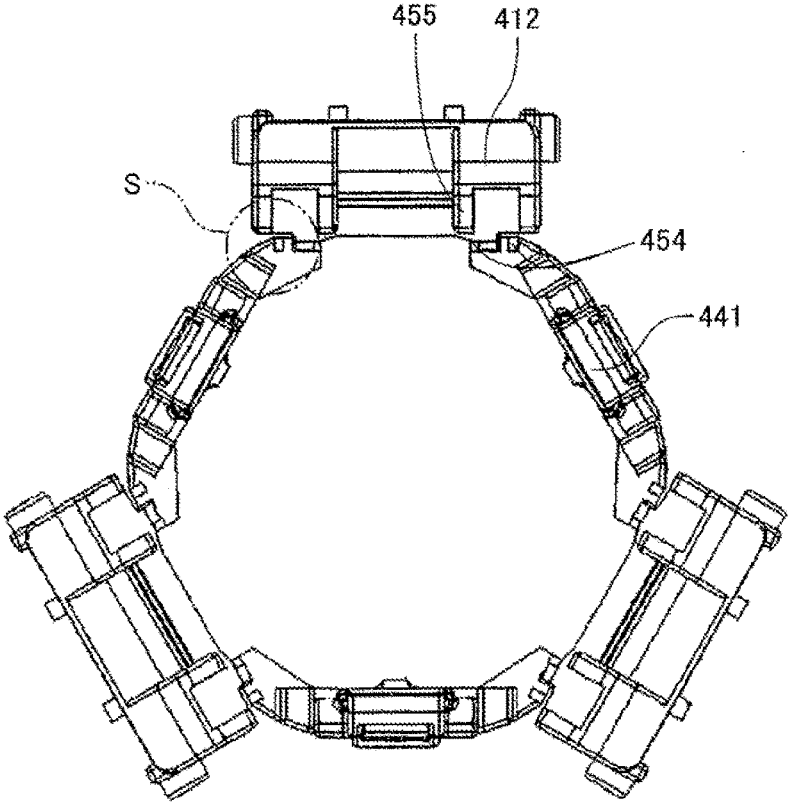
FIG. 34 is a diagram viewed from the shaft center of the roll when the locking mechanism is in a locked status.
Figure 35:
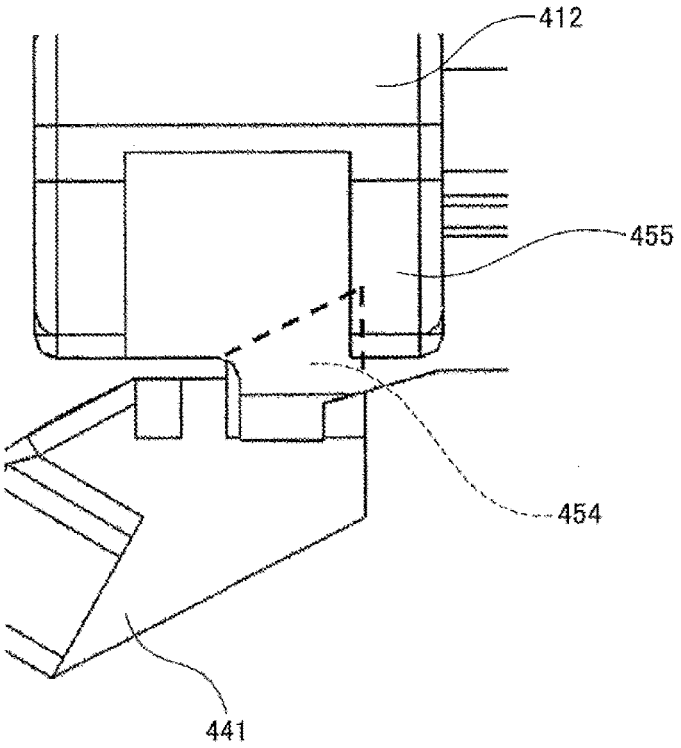
FIG. 35 is an enlarged diagram illustrating an S part of FIG. 34.

Next, a locking mechanism of the locking device is illustrated with reference to FIGS. 28 to 35. FIG. 28 is a perspective diagram illustrating a locking member of the locking mechanism, FIG. 29 is a front diagram illustrating the locking mechanism, and FIG. 30 is a perspective diagram illustrating a boss part of the locking mechanism. FIG. 31 is a sectional front diagram illustrating an engaging position of an engaging part of the locking mechanism, FIG. 32 is a sectional side diagram illustrating the engaging part of the locking mechanism, FIG. 33 is a diagram illustrating an unlocked status of the locking mechanism viewing from an axial direction of the roll, FIG. 34 is a diagram illustrating a locked status of the locking mechanism, and FIG. 35 is an enlarged diagram illustrating an S part of FIG. 34.

Ad described earlier, the locking mechanism 440 includes a locking member 441. The cylindrical shaft 403 of the retaining member 401 is provided with a guiderail 442 configured to regulate movement of the locking member 441 in a radial direction of the axis.

The locking member 441 has the boss part 451 movable in a radial direction (an arrow m direction in FIG. 28) along the guiderail 442. Further, the boss part 451 may have a shape such as a circular-shape, a D-shape, or an oval-shape such that the locking member 441 is rotatable in an arrow direction in FIG. 29 around the axial direction of the retaining member 401 as illustrated in FIGS. 29 and 30. Further, the locking member 441 includes two boss parts 451 in order to move in a horizontal direction.

Accordingly, the locking member 441 may be pivotally retained around the axial direction of the retaining member 401.

The elastic member 453 is attached between the locking member 441 and the cylindrical shaft 403 of the retaining member 401 such that force is applied to the locking member 441 in a direction departing from the axial direction.

The locking member 441 includes an engaging part 454, and the support switching member 412 is provided with an engaged projection 455 to be engaged with the engaging part 454.

When the support switching member 412 is located at the supporting position to support the roll having the second inner diameter, the locking member 441 is at the position at which the engaging part 454 engages with the engaged projection 455. Thus, the movement of the support switching member 412 toward the axial direction is interrupted.

Then, the roll retainer is fit into the roll having the first diameter, the locking member 441 is pushed into a direction approaching the axial direction so that the engaging part 454 departs from the position at which the engaging part 454 engages with the engaged projection 455. Thus, the support switching member 412 is unlocked.

Note that as illustrated in FIG. 31, one support switching member 412 is provided with two or more engaged projections 455. The locking member 441 includes one engaging part 454 with respect to one projection 455 of the support switching member 412. Accordingly, two or more parts of the support switching member 412 need to be unlocked in order to move the support switching member 412.

Further, the thrust position of the locking member 441 is received by the surface of the based on the retaining member 401, as illustrated in FIG. 32.

In this configuration, when the support switching member 412 is unlocked, the locking member 441 approaches the axis to provide space 450 between the projection 455 of the support switching member 412 and the engaging part 454 of the locking member 441. As a result, the support switching member 412 may become movable.

On the other hand, when the support switching member 412 is locked, the locking member 441 departs from the axis to allow the projection 455 of the support switching member 412 to be in contact with the engaging part 454 of the locking member 441. As a result, the movement of the support switching member 412 is locked.

Figure 36:
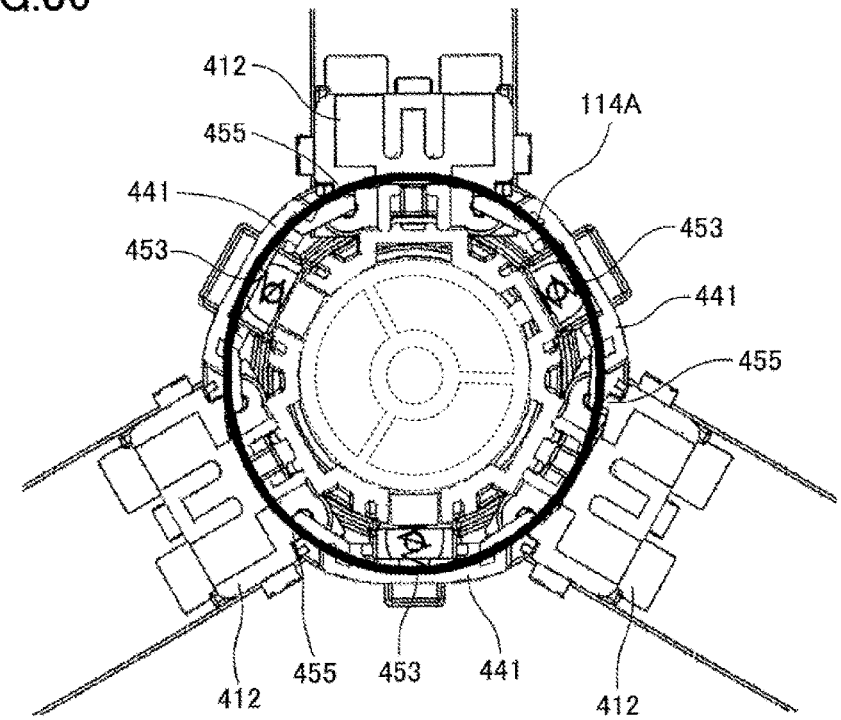
FIG. 36 is a diagram illustrating a relationship between a location of the locking member of the locking device and a hollow shaft of the roll having the first inner diameter.
Figure 37:
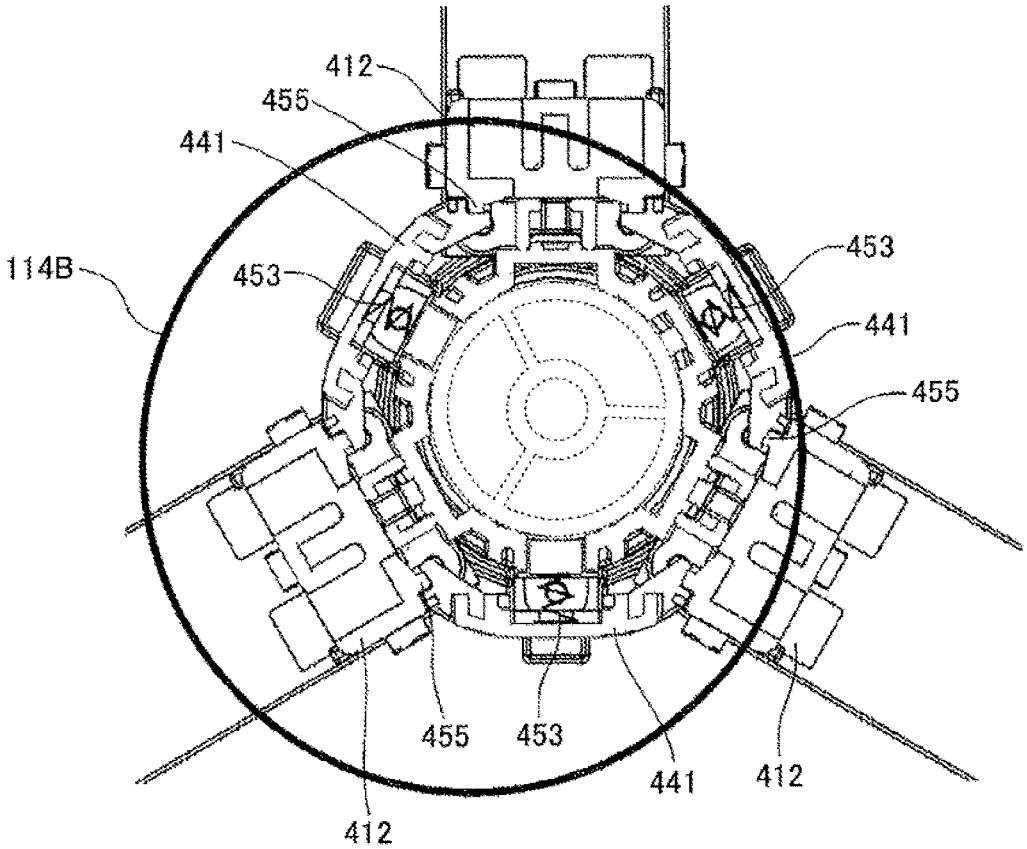
FIG. 37 is a diagram illustrating a relationship between the location of the locking member of the locking device and a hollow shaft of the roll having the second inner diameter.

Next, a description is given, with reference to FIGS. 36 and 37, of a relationship between the locking member of the locking device and the size of the roll. FIG. 36 is a diagram illustrating a relationship between arrangement of the locking member and the hollow shaft of the roll having the first inner diameter, and FIG. 37 is a diagram illustrating a relationship between arrangement of the locking member and the hollow shaft of the roll having the second inner diameter.

The locking members 441 are disposed in a circumferential direction on the cylindrical shaft 403 of the retaining member 401. Then, as illustrated in FIG. 36, the locking members 441 are pushed in a radial direction by inserting the hollow shaft 114A of the roll 112 having the first inner diameter.

As a result, the support switching members 412 locked by the locking members 441 may be unlocked.

On the other hand, as illustrated in FIG. 37, two or more the locking members 441 are unable to be pushed in a radial direction by inserting the hollow shaft 114B of the roll 112 having the second inner diameter. Hence, the support switching members 412 locked by the two locking members 441 are not completely unlocked by inserting the roll 112 having the second inner diameter.

Accordingly, when the roll retainer is fit into the roll 112 having the second inner diameter, the support switching members 412 are still locked and unmoved, such that the support switching members 412 are fit into the roll 112 having the second inner diameter to support the roll 112.

That is, the locking devices 400 configured to lock the respective support switching members 412 are located such that the support switching members 412 are not simultaneously unlocked when the roll retainer fits into the roll 112 having the second inner diameter.

Figure 38:
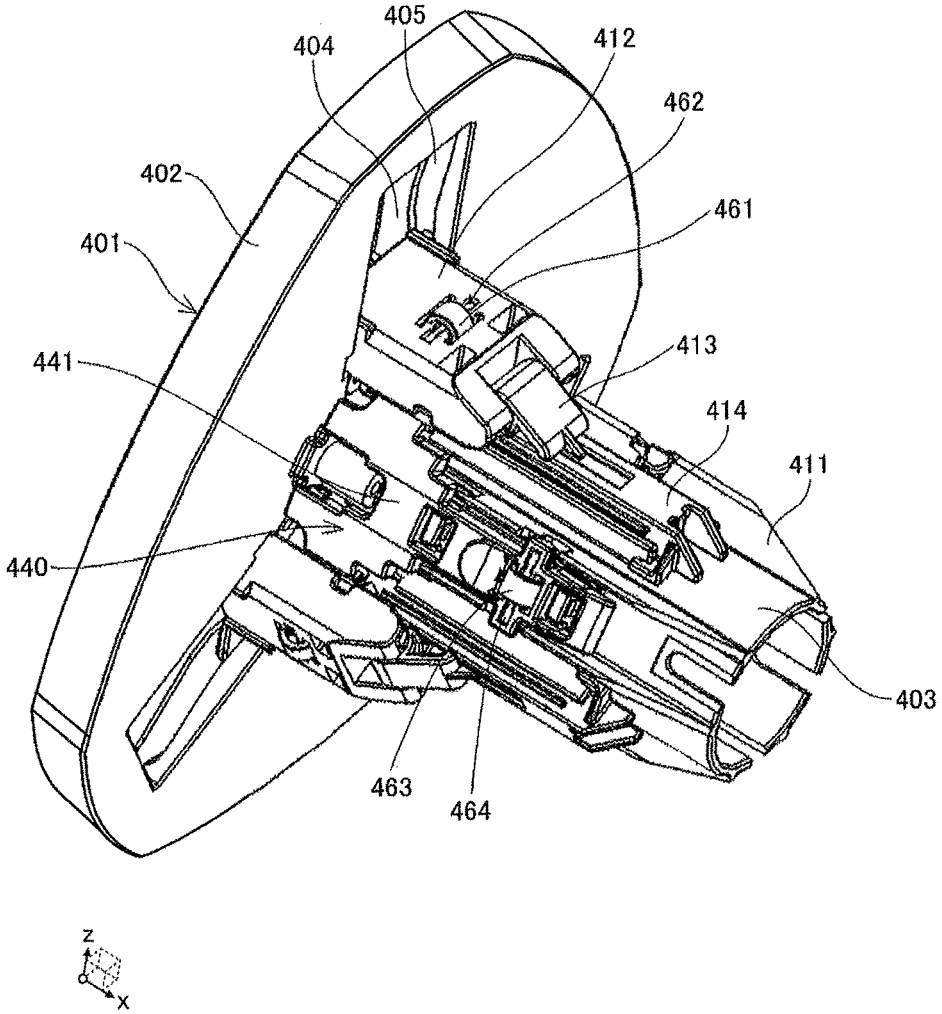
FIG. 38 is a perspective diagram illustrating a supporting structure of the roll in the roll retainer according to the seventh embodiment.

Next, a description is given, with reference to FIG. 38, of a supporting structure of the roll. FIG. 38 is a perspective diagram illustrating the supporting structure of the roll.

An inner diameter retaining member 461 configured to retain an inner peripheral surface of the hollow shaft 114 of the roll 112 having the second inner diameter is pivotally retained via a shaft 462 on each of the support switching members 412.

An inner diameter retaining member 463 configured to retain an inner peripheral surface of the hollow shaft 114 of the roll 112 having the first inner diameter is pivotally retained via a shaft 463 on each of the locking members 441.

The inner diameter retaining members 461 and 463 are pivotally disposed along an attaching or detaching direction (fitting direction with respect to the roll) of the roll 112. Then, multiple inner diameter retaining members 461 and 463 are disposed in a circumferential direction of the cylindrical shaft 403 such that the incircle connecting edges of the multiple inner diameter retaining members 461 and multiple inner diameter retaining members 463 are larger than the size of the hollow shaft 114 of the roll 112. Accordingly, the edges intrude into the hollow shaft 114 to retain the roll 112 with respect to rotations around the axis.

Further, since the inner diameter retaining members 461 and 463 are pivotally disposed along the attaching or detaching direction of the roll 112, frictional resistance against fitting into the roll 112 may be reduced.

Figure 39:
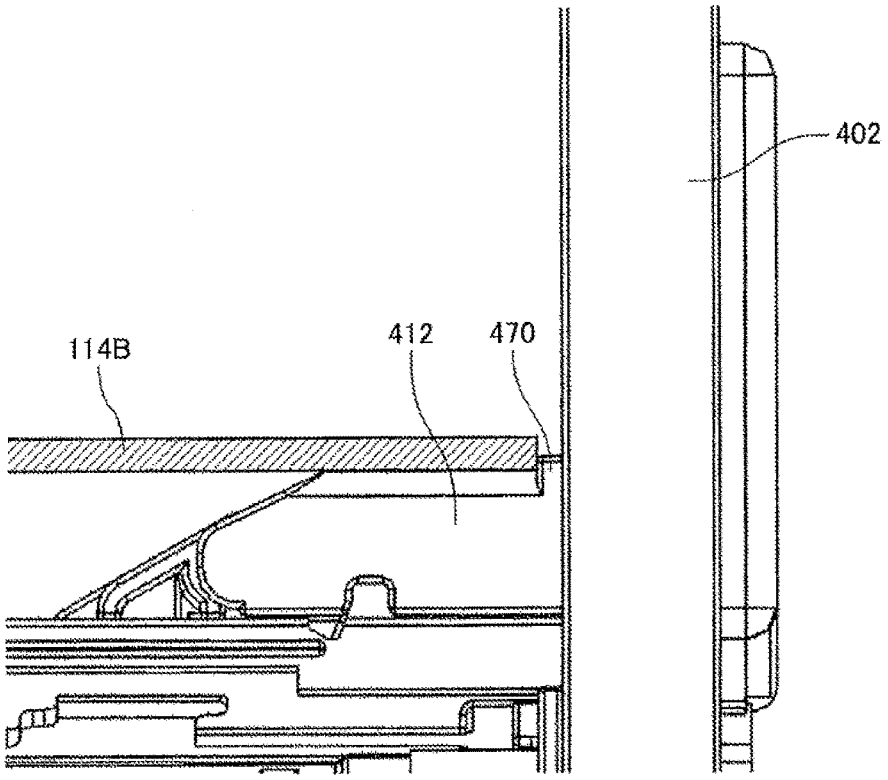
FIG. 39 is a cross-sectional diagram illustrating an insertion position restriction structure with respect to the roll in the main part of the roll retainer according to the seventh embodiment.

Next, a description is given, with reference to FIG. 39, of an insertion position restriction structure with respect to the roll. FIG. 39 is a cross-sectional diagram illustrating a main part of the insertion position restriction structure.

The support switching member 412 includes a rib 470 serving as a thrust position determining device configured to determine a position in the axial direction of the roll 112 having the second inner diameter on the base 402 side of the retaining member 401. The rib 470 is formed at a position higher than that of the hollow shaft 114B of the roll having the second inner diameter.

With this configuration, the hollow shaft 114B of the roll 112 having the second inner diameter will not be inserted toward the base 402 side beyond the rib 470, thereby locating the position of the roll 112 having the second inner diameter.

Figure 40:
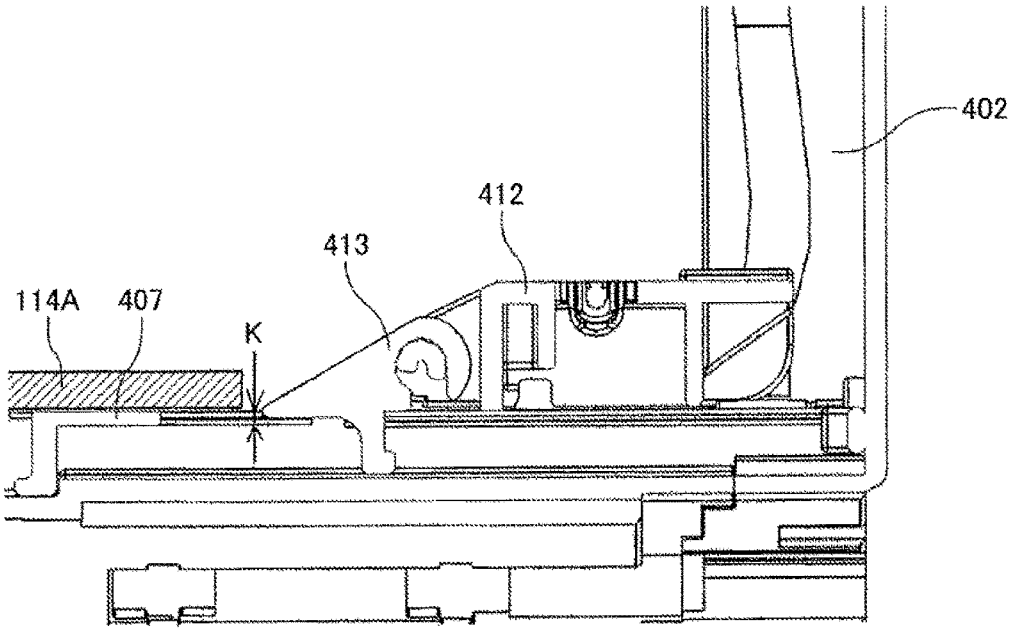
FIG. 40 is a cross-sectional diagram illustrating a positional relationship between a link and a guiderail in the main part of the roll retainer according to the seventh embodiment.

Next, a description is given, with reference to FIG. 40, of a positional relationship between the link 413 and the guiderail 414. FIG. 40 is a cross-sectional diagram illustrating a main part of the positional relationship between the link 413 and the guiderail 414.

The link 413 attached to the support switching member 412 includes a taper part 413*a*, and a front end of the taper part 413*a* is disposed at a position lower than an upper surface of the guiderail 414 so as to form a space K.

Accordingly, to insert the roll 112 having the first inner diameter, the end face of the hollow shaft 114A will not be in contact with a vertical plane in an inserting direction of the link 413. As a result, the link 413 may be able to be pushed into the base 402 side without any interruption.

Figure 41:
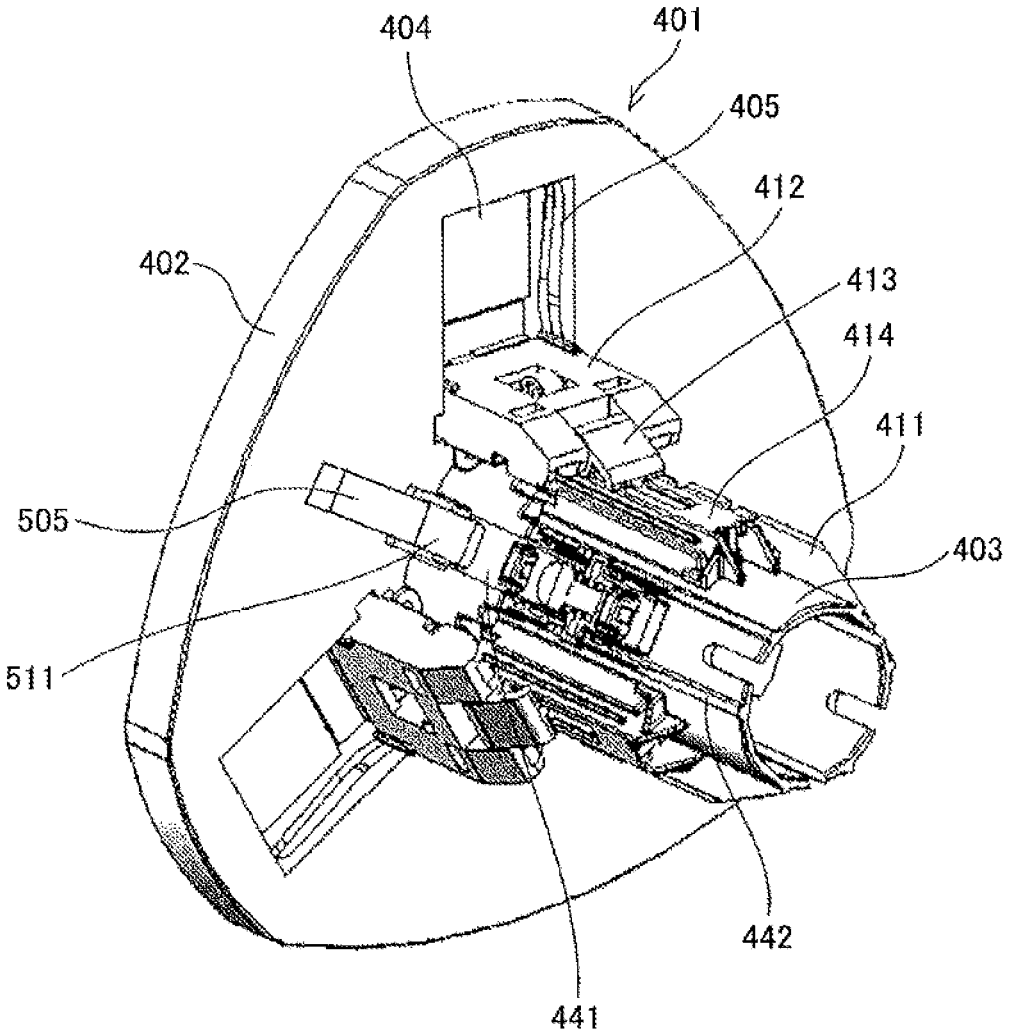
FIG. 41 is an internal perspective diagram illustrating a roll retainer according to an eighth embodiment having a retaining member to which an extruding member is attached.
Figure 42:
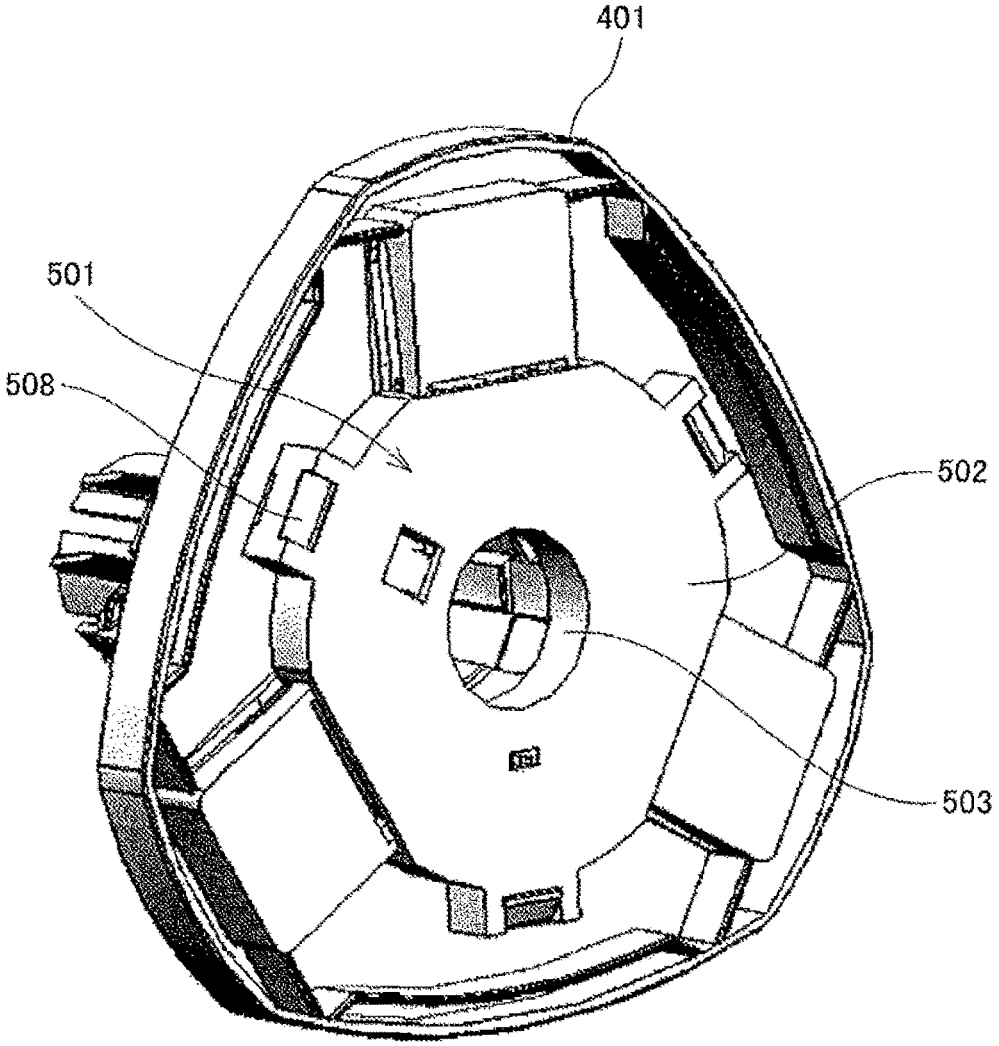
FIG. 42 is an external perspective diagram illustrating the roll retainer according to the eighth embodiment.
Figure 43:
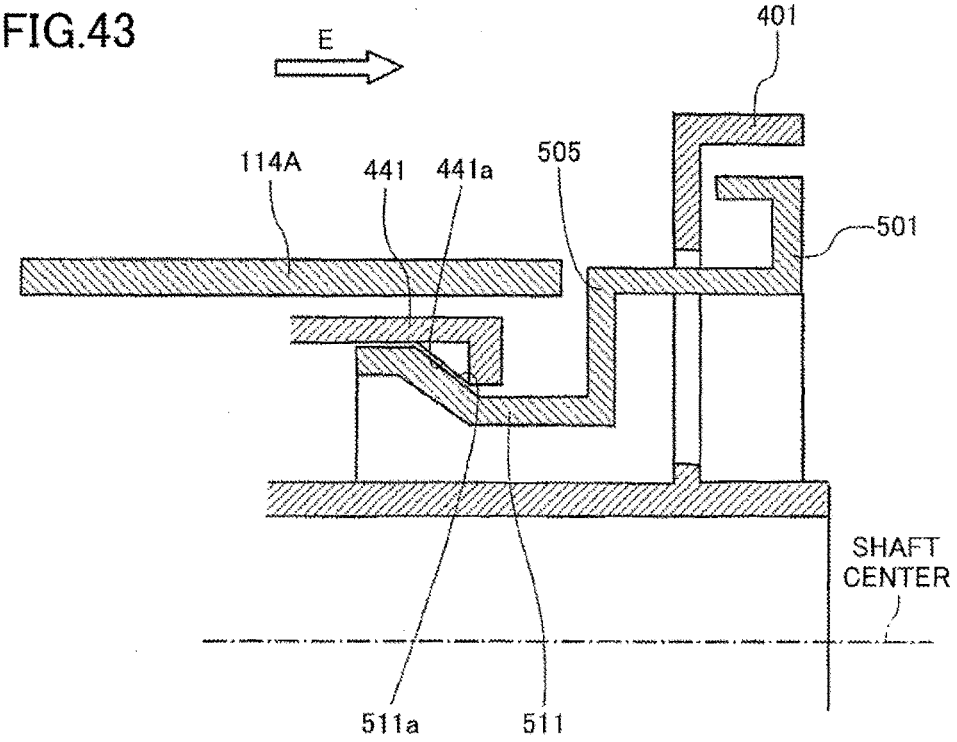
FIG. 43 is a cross-sectional diagram illustrating the roll retainer that retains the roll having the first inner diameter.
Figure 44:
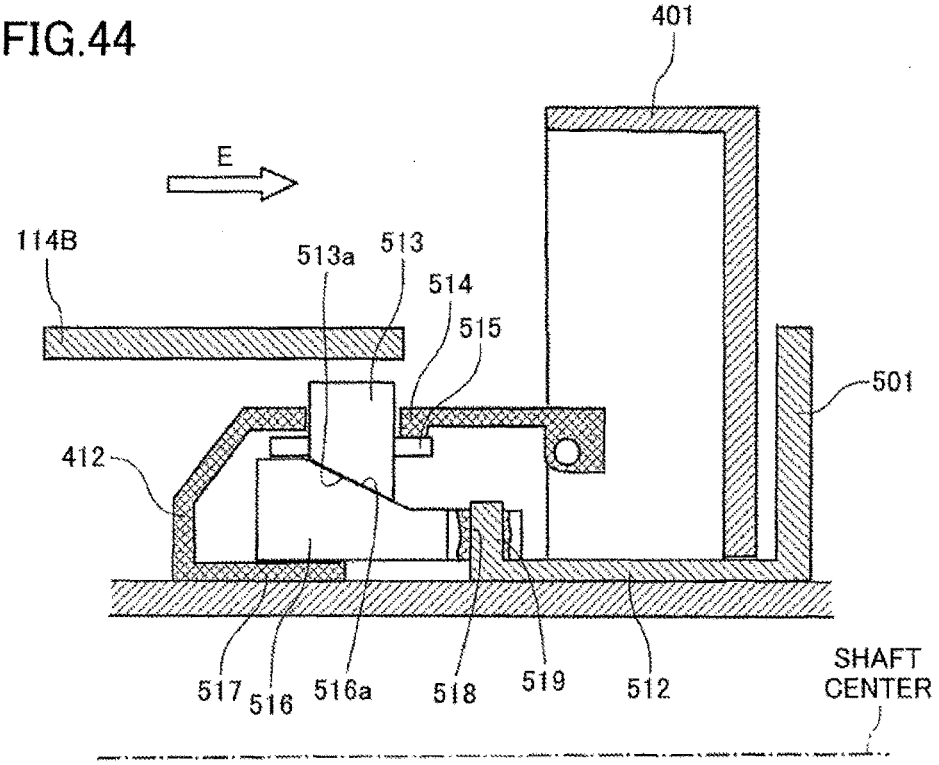
FIG. 44 is a cross-sectional diagram illustrating the roll retainer that retains the roll having the second inner diameter.

Next, a description is given, with reference to FIGS. 41 to 44, of a roll retainer according to an eighth embodiment. FIG. 41 is an internal perspective diagram illustrating a roll retainer to which an extruding member is attached, and FIG. 42 is an external perspective diagram illustrating the roll retainer to which the extruding member is attached. FIG. 43 is a cross-sectional diagram illustrating the roll retainer retaining the roll having the first inner diameter, and FIG. 44 is a cross-sectional diagram illustrating the roll retainer retaining the roll having the second inner diameter. Note that components of the eighth embodiment similar to those of the seventh embodiment are provided with the same reference numbers, and a duplication illustration is omitted from the specification.

An extruding member 501 is movably attached outside (a side opposite to the roll) the retaining member 401. The extruding member 501 may be attached to the retaining member via a snap-fit 508.

The extruding member 501 is provided with a guide 503 such that the extruding member 501 is relatively moved with respect to the retaining member 401. The relative movement of the extruding member 501 is restricted between the base 402 of the retaining member 401 and a snap-fit surface of the retaining member 401.

The extruding member 501 includes a roll end-surface contact part 505. The roll end-surface contact part 505 is disposed such that the roll end-surface contact part 505 projects from the base 402 of the retaining member 401 in the axial direction, and the roll end-surface contact part 505 may be brought into contact with any one of the hollow shaft 114A of the roll 112 having the first inner diameter, and the hollow shaft 114B of the roll 112 having the first inner diameter.

When external force is applied to the roll end-surface contact part 505 in a direction in which the roll 112 is fit into the retaining member 401, the extruding member 501 relatively moves with respect to the retaining member 401.

Then, the base 506 is provided with the first extruding parts 511 and the second extruding parts 512 corresponding to multiple (three in this case) extruding members corresponding to the locking members 441 and the support switching members 412.

The first extruding parts 511 and the second extruding parts 512 are the extruding members in the embodiments of the present invention. The multiple extruding parts (extruding members) that are integrally coupled are disposed on the base 506 of the extruding member 501 so as to integrate the movements of extruding parts (extruding members).

First, the locking members 441 are disposed on the retaining member 401 such that the locking members 441 support the hollow shaft 114A of the roll 112 having the first inner diameter, and movable in a radial direction orthogonal to the axial direction.

Then, the first extruding part 511 is provided with an inclined part 511*a* inclined in a radial direction in the axial direction as illustrated in FIG. 43. The inclined part 511*a* is inclined in a direction toward a roll fitting direction (an arrow E direction). On the other hand, the locking member 441 includes an inclined part 441*a* in contact with the inclined part 511*a* of the first extruding part 511.

The inclined part 511*a* of the first extruding part 511 and the inclined part 441*a* of the locking member 441 are linked with the movement of the extruding member 501 to form a moving device configured to move the locking member 441 in a direction to increase a supporting position of the roll 112 having the first inner diameter in a radial direction.

Hence, when the hollow shaft 114A of the roll 112 having the first inner diameter is fit from an arrow E direction, the hollow shaft 114A is brought into contact with the roll end-surface contact part 505 of the extruding member 501. Moving the hollow shaft 114A of the roll 112 having the first inner diameter from this state further in the arrow E direction also moves the extruding member 501 in the arrow E direction, thereby pushing the inclined part 441*a* of the locking member 441 with the inclined part 511*a* of the first extruding part 511 in a radial direction departing from the axial direction.

Accordingly, the hollow shaft 114A of the roll 112 having the first inner diameter is moved by the locking member 441 in a direction of increasing the supporting position of the hollow shaft 114A of the roll 112 having the first inner diameter.

Next, as illustrated in FIG. 44, the support switching member 412 is provided with a supporting member 513 configured to support the hollow shaft 114B of the roll 112 having the second diameter. The supporting member 513 is guided by the guide 514 and movable in a radial direction.

The supporting member 513 moving to be detached from the support switching member 412 is restricted by the projection 515, and the retaining member 401 moving toward the axial direction is restricted by a position adjusting member 516.

An inclined part 513*a* of the supporting member 513 is disposed such that the inclined part 513*a* of the supporting member 513 is in contact with an inclined part 516*a* of the position adjusting member 516. The position adjusting member 516 is guided by a guide 517, and is movable in the axial direction. An engaging part 519 disposed on the second extruding part 512 is engaged with a groove 518 of the position adjusting member 516.

The inclined part 513*a* of the supporting member 513 and the inclined part 516*a* of the position adjusting member 516 are linked with the movement of the extruding part 512 (extruding member) to form a moving device configured to move the supporting member 513 in a radial direction to increase a supporting position of the roll 112 having the second inner diameter in a radial direction.

Hence, when the hollow shaft 114B of the roll 112 having the second inner diameter is fit from the arrow E direction, the hollow shaft 114B is brought into contact with the roll end-surface contact part 505 (see FIG. 43) of the extruding member 501. Moving the hollow shaft 114B of the roll 112 having the second inner diameter from this state further in the arrow E direction also moves the extruding member 501 in the arrow E direction, thereby moving the position adjusting member 516 in the arrow E direction.

When the position adjusting member 516 is moved in the arrow E direction, the inclined part 516*a* of the position adjusting member 516 pushes the inclined part 513*a* of the supporting member 513 in a radial direction departing from the axial direction.

Accordingly, the hollow shaft 114B of the roll 112 having the second inner diameter is moved by the supporting member 513 of the support switching member 412 in a direction of increasing the supporting position of the hollow shaft 114B of the roll 112 having the second inner diameter.

As a result, when the roll 112 is fit into the retaining member 401, the locking member 441 or the supporting member 513 is moved in a direction of increasing the supporting position. Hence, the roll retainer of this embodiment may be able to reduce the eccentricity of the roll 112 to reliably retain the roll even though the diameter of the hollow shaft 114 of the roll 112 varies.

By contrast, in the configuration in which the shaft center of the retaining member displaces the rib supporting an inner peripheral surface of the roll by a cam in a radial direction, it may be necessary to have a locking mechanism configured to lock the rib while being in contact with the inner peripheral surface of the roll. Further, in the configuration in which the shaft center of the retaining member supports the inner peripheral surface of the roll with an elastic member, the retained roll may become eccentric with respect to the spool shaft due to the flexure of the elastic member.

However, in the configuration of the embodiment, the operation of fitting the roll may simply increase the diameter of the supporting position to retain the roll, and the diameter of the supporting position is increased after fitting the roll without using the elasticity. Accordingly, the eccentricity with respect to the spool shaft may be reduced and the roll may be retained by increasing the diameter of the supporting position without increasing the inserting force of the roll.

Figure 45:
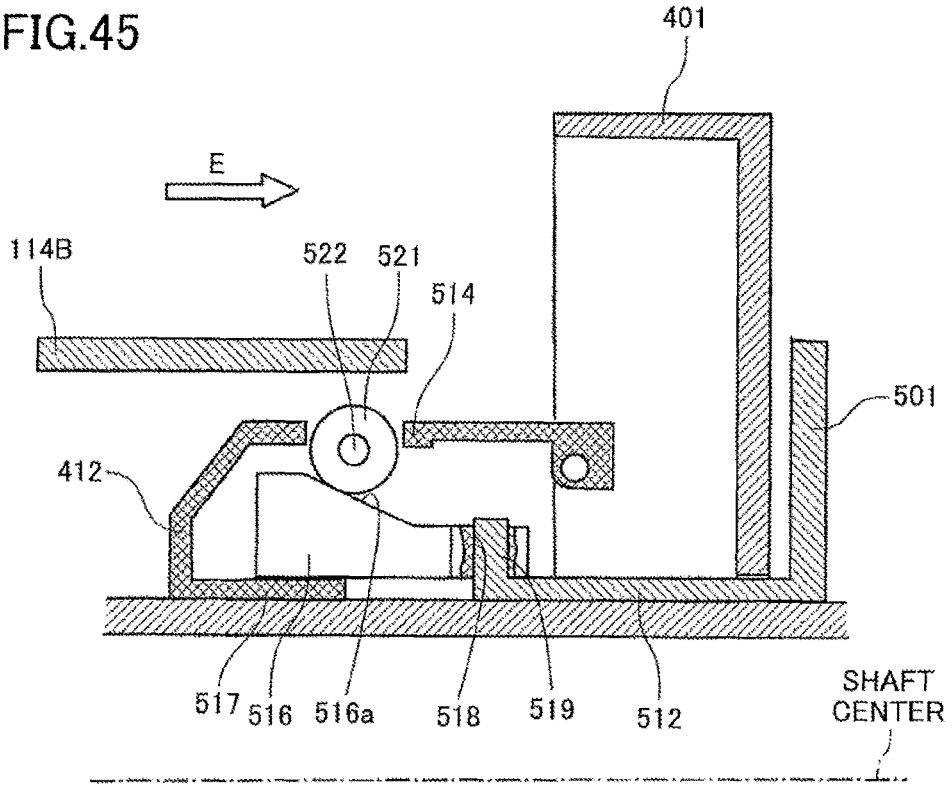
FIG. 45 is a perspective diagram illustrating a roll retainer according to a ninth embodiment when retaining the roll having the second inner diameter.

Next, a description is given, with reference to FIG. 45, of a roll retainer of a ninth embodiment. FIG. 45 is a cross-sectional diagram illustrating the roll retainer retaining the roll having the second inner diameter.

In the ninth embodiment, the support switching member 412 includes a rotor 521 serving as a supporting member configured to support the roll 112 having the second inner diameter. A shaft 522 of the rotor 521 is disposed in a direction orthogonal to the shaft center of the roll.

Accordingly, the shaft 522 of the rotor 521 may be able to restrict the movement limit of the rotor 521. Further, friction load at the time of inserting the roll 112 may be reduced by rotation of the rotor 521.

Figure 46:
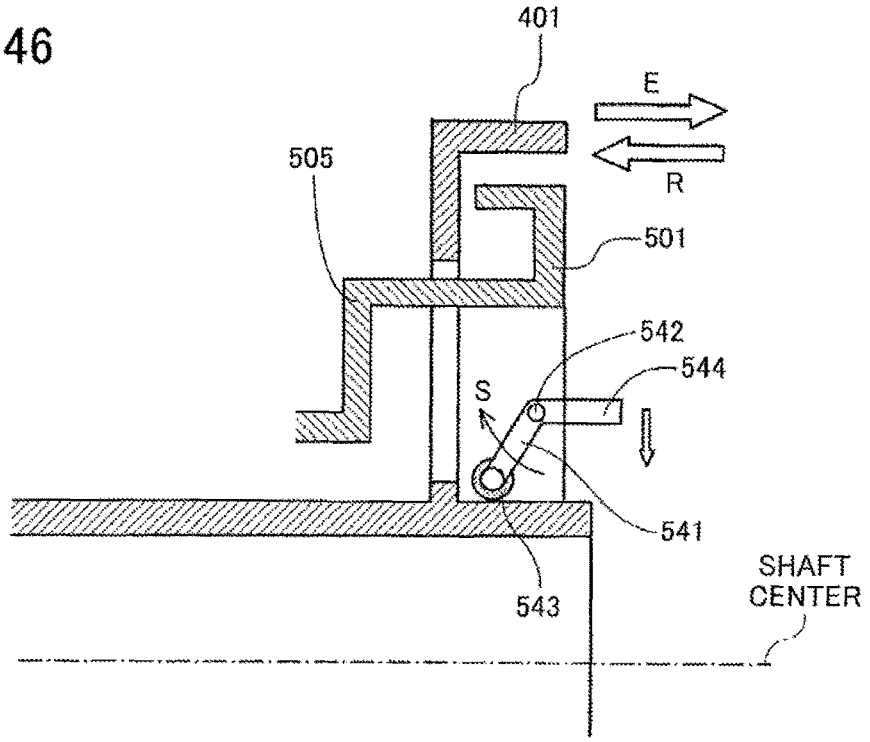
FIG. 46 is a cross-sectional diagram illustrating a locking device (a locking mechanism) of an extruding member of a roll retainer according to a tenth embodiment.

Next, a description is given, with reference to FIG. 46, of a roll retainer of a tenth embodiment. FIG. 46 is a cross-sectional diagram illustrating a locking device (a locking mechanism) of an extruding member of the roll retainer of the tenth embodiment.

A locking member 541 is attached to an extruding member 501 disposing a rotational shaft 542 in a direction orthogonal to the axial direction. A friction member 543 is attached to a front end of the locking member 541, and the friction member 543 is disposed such that the friction member 543 is in contact with the retaining member 401.

Then, when the extruding member 501 is moved in an arrow E direction (a direction in which the roll 112 is fit into the retaining member 401), the locking member 541 is turned in an arrow S direction such that a distance between the center of the shaft 542 and the contact point of the friction member 543 is increased. As a result, the extruding member 501 moves without interruption.

On the other hand, when the roll 112 is moved in an arrow R direction in order to detach the roll 112 from the retaining member 401, force toward an arrow R direction may be applied to the extruding member 501. However, the friction member 543 is frictionally in contact with the retaining member 401 such that the locking member 401 is forced to turn in a direction of decreasing a distance between the center of the shaft 542 of the locking member 401 and the contact point of the friction member 543. As a result, the extruding member 501 is locked.

Note that when the extruding member 501 is moved in the arrow R direction, the extruding member 501 turns in the arrow S direction by pressing a lever 544 in an arrow T direction. As a result, the friction member 543 will not be in contact with the retaining member 401, thereby unlocking the extruding member 501.

According to the disclosed embodiments, the roll retainer may be able to easily retain the rolls having different diameters.

The present invention is not limited to the specifically disclosed embodiments, and variations and modifications may be made without departing from the scope of the present invention.

The present application is based on and claims the benefit of priority of Japanese Priority Application No. 2014-229856 filed on Nov. 12, 2014, and Japanese Priority Application No. 2015-053826 filed on Mar. 17, 2015, the entire contents of which are hereby incorporated herein by reference.

What is claimed is:

1. A roll retainer fitting into ends of a roll having a first inner diameter to retain or ends of a roll having a second inner diameter greater than the first inner diameter to retain a corresponding one of the rolls, the roll retainer comprising:

a retaining member having a base facing one end of the roll;

two or more support switching members disposed in the retaining member and configured to be movable in an axial direction, each of the support switching members being movable between a supporting position at which the support switching member supports the roll having the second inner diameter and a retracted position to which the support switching member is retracted from the supporting position and at which the support switching member supports the roll having the first inner diameter; and two or more locking devices configured to lock movement of the corresponding support switching members, and unlock the movement of the corresponding support switching members when the roll retainer fits into the roll having the first inner diameter, wherein when the roll retainer fits into the roll having the first inner diameter, the locking devices unlock the locked support switching members, and the support switching members are pushed by the end of the roll having the first inner diameter such that the support switching members are moved to the respective retracted positions.

2. The roll retainer as claimed in claim 1, further comprising:

an elastic member configured to press a corresponding one of the support switching members toward the corresponding supporting position, wherein when the roll retainer is removed from the roll having the first inner diameter, the support switching members return to the respective supporting positions.

3. The roll retainer as claimed in claim 1, wherein the locking devices configured to lock the respective support switching members are located such that the support switching members are not simultaneously unlocked when the roll retainer fits into the roll having the second inner diameter.

4. The roll retainer as claimed in claim 1, wherein each of the support switching members turns in a direction orthogonal to an axial direction while sliding in the axial direction.

5. The roll retainer as claimed in claim 1, wherein at least one of the support switching members and the locking devices includes a rotor configured to be pivotally in contact with the hollow shaft of the roll.

6. The roll retainer as claimed in claim 1, wherein each of the locking devices is pivotally retained in a circumferential direction of a cylindrical shaft of the retaining member.

7. The roll retainer as claimed in claim 1, wherein each of the support switching members is provided with a locator configured to determine a position in an axial direction of the roll having the second inner diameter.

8. The roll retainer as claimed in claim 1, wherein each of the locking devices is movable in a direction orthogonal to the axial direction.

* * * * *